US011420843B2

(12) United States Patent
Yamazaki

(10) Patent No.: US 11,420,843 B2
(45) Date of Patent: Aug. 23, 2022

(54) REEL MEMBER, FILM HOUSING BODY, AND METHOD FOR MANUFACTURING REEL MEMBER

(71) Applicant: DEXERIALS CORPORATION, Tokyo (JP)

(72) Inventor: Toyoji Yamazaki, Tokyo (JP)

(73) Assignee: DEXERIALS CORPORATION, Tokyo (JP)

( * ) Notice: Subject to any disclaimer, the term of this patent is extended or adjusted under 35 U.S.C. 154(b) by 352 days.

(21) Appl. No.: 15/750,916

(22) PCT Filed: Aug. 5, 2016

(86) PCT No.: PCT/JP2016/073154
§ 371 (c)(1),
(2) Date: Feb. 7, 2018

(87) PCT Pub. No.: WO2017/026404
PCT Pub. Date: Feb. 16, 2017

(65) Prior Publication Data

US 2018/0229961 A1 Aug. 16, 2018

(30) Foreign Application Priority Data

Aug. 10, 2015 (JP) ..... 2015-158071
Aug. 10, 2015 (JP) ..... JP2015-158070

(51) Int. Cl.
*B65H 75/14* (2006.01)
*B65H 75/18* (2006.01)
*B65H 54/28* (2006.01)

(52) U.S. Cl.
CPC ..... *B65H 75/14* (2013.01); *B65H 54/2851* (2013.01); *B65H 75/18* (2013.01); *B65H 2701/377* (2013.01); *B65H 2701/535* (2013.01)

(58) Field of Classification Search
CPC .... B65H 75/14; B65H 75/18; B65H 54/2851; B65H 2701/377; B65H 2701/535
See application file for complete search history.

(56) References Cited

U.S. PATENT DOCUMENTS 2,541,476 A * 2/1951 Mihalyi ..... G03B 17/30 242/583
3,041,005 A * 6/1962 Wallace ..... G03B 21/321 242/609.1

(Continued)

FOREIGN PATENT DOCUMENTS

CN 1286175 A 3/2001
CN 102530612 A 7/2012

(Continued)

OTHER PUBLICATIONS

Aug. 12, 2019, Korean Office Action issued for related KR Application No. 10-2017-7036119.

(Continued)

*Primary Examiner* — Michael E Gallion
(74) *Attorney, Agent, or Firm* — Paratus Law Group, PLLC

(57) ABSTRACT

There is provided a new and improved reel member and a new and improved reel housing body that can suppress surface runout and accordingly suppress falling-off of an adhesive film, the reel member (1) including: a winding core section (2) around which an adhesive film is windable; and a flange section (3) provided on each of both end portions in a direction of a rotation axis of the winding core section, in which the winding core section and the flange section are provided separately from each other, and an amount of surface runout of the flange section is a value within a range of ±0.2 mm. For example, a diameter of the winding core (Continued)

section and a diameter of the flange section may satisfy a predetermined mathematical formula.

18 Claims, 10 Drawing Sheets

(56) References Cited

U.S. PATENT DOCUMENTS

| | | | | | |
|---|---|---|---|---|---|
| 4,149,681 | A * | 4/1979 | Schluter | A24C 5/20 | 242/575 |
| 5,548,368 | A * | 8/1996 | Lee | G03B 1/60 | 396/515 |
| 5,564,647 | A * | 10/1996 | Bay | B65H 75/22 | 242/608.8 |
| 6,045,087 | A * | 4/2000 | Vislocky | B65H 75/14 | 242/608.2 |
| 6,196,495 | B1 * | 3/2001 | Hwang | B65H 75/14 | 242/608.2 |
| 6,450,438 | B1 * | 9/2002 | McAllister | B65H 18/00 | 242/346.2 |
| 6,932,295 | B1 * | 8/2005 | Underkofler | B65H 75/14 | 242/345.2 |
| 9,908,737 | B2 * | 3/2018 | Chastain | B65H 49/322 | |
| 2002/0017588 | A1 * | 2/2002 | Kitayama | B65H 75/22 | 242/608.6 |
| 2002/0125364 | A1 * | 9/2002 | Ripplinger | B65H 75/18 | 242/614.1 |
| 2004/0050996 | A1 * | 3/2004 | Russell | B65H 75/18 | 242/605 |
| 2007/0257149 | A1 * | 11/2007 | Sumiya | B65H 75/30 | 242/610.4 |
| 2011/0290931 | A1 * | 12/2011 | Pauwels | B65H 75/14 | 242/611 |
| 2012/0055831 | A1 * | 3/2012 | Vulpitta | B65H 75/16 | 206/411 |
| 2013/0334353 | A1 * | 12/2013 | Takenoshita | B65H 75/14 | 242/118.6 |
| 2014/0312159 | A1 * | 10/2014 | Troitzsch | B65H 54/543 | 242/608.2 |
| 2016/0251195 | A1 * | 9/2016 | Hikiji | B65H 54/28 | 242/614 |
| 2017/0259476 | A1 * | 9/2017 | Suzuki | B65H 3/0638 | |
| 2018/0201468 | A1 * | 7/2018 | Ferraro | B65H 75/14 | |
| 2019/0016555 | A1 * | 1/2019 | Wlasak | B65H 75/14 | |
| 2019/0218056 | A1 * | 7/2019 | Chen | B65H 75/146 | |

FOREIGN PATENT DOCUMENTS

| | | | |
|---|---|---|---|
| CN | 103958384 | A | 7/2014 |
| CN | 104203789 | A | 12/2014 |
| JP | S54-080747 | U | 6/1979 |
| JP | S60-214489 | A | 10/1985 |
| JP | H06-080314 | A | 3/1994 |
| JP | 2013-216436 | A | 10/2013 |
| JP | 2014-037315 | A | 2/2014 |
| JP | 2014-043346 | A | 3/2014 |
| JP | 2015-086029 | A | 5/2015 |
| JP | 2016-024168 | A | 2/2016 |
| KR | 10-0199703 | B1 | 6/1999 |

OTHER PUBLICATIONS

Jan. 4, 2019, Chinese Office Action issued for related CN Application No. 201680043392.7.

Feb. 21, 2019, Korean Office Action issued for related KR Application No. 10-2017-7036119.

* cited by examiner

REEL MEMBER, FILM HOUSING BODY, AND METHOD FOR MANUFACTURING REEL MEMBER

CROSS REFERENCE TO PRIOR APPLICATION

This application is a National Stage Patent Application of PCT International Patent Application No. PCT/JP2016/073154 (filed on Aug. 5, 2016) under 35 U.S.C. § 371, which claims priority to Japanese Patent Application Nos. 2015-158071 (filed on Aug. 10, 2015) and 2015-158070 (filed on Aug. 10, 2015), which are all hereby incorporated by reference in their entirety.

TECHNICAL FIELD

The present invention relates to a reel member, a film housing body, and a method for manufacturing a reel member.

BACKGROUND ART

There is known a reel member around which an adhesive film is windable, as disclosed in, for example, Patent Literatures 1 to 3. The reel member includes a winding core section around which an adhesive film is wound and a flange section provided on each of both end portions of the rotation axis of the winding core section. The adhesive film is protected by the flange sections, and therefore the contamination of the adhesive film can be suppressed. Furthermore, the handleability of the reel member around which the adhesive film is wound, that is, a film housing body is improved.

CITATION LIST

Patent Literature

Patent Literature 1: JP 2015-86029A
Patent Literature 2: JP 2014-43346A
Patent Literature 3: JP 2013-216436A

SUMMARY OF INVENTION

Technical Problem

However, when manufacturing a reel member, no consideration has so far been given to surface runout. Hence, there has been a case where the amount of surface runout is very large. Here, the surface runout means that the flange section sways (warps) in the direction of the rotation axis of the winding core section. The surface runout is categorized into surface runout in the positive direction in which the flange section sways toward the outside of the rotation axis of the winding core section (that is, the flange section warps to the outside of the reel member) and surface runout in the negative direction in which the flange section sways toward the inside of the rotation axis of the winding core section (that is, the flange section warps to the inside of the reel member). There is also a case where both surface runout in the positive direction and surface runout in the negative direction occur in one flange section. That is, there is a case where surface runout in the positive direction occurs in a part of the flange section and surface runout in the negative direction occurs in another part.

In the case where an adhesive film is wound around a reel member with a large surface runout, the adhesive film is likely to fall off into the gap between a flange section and a film winding section (a portion where the adhesive film is wound). This is because the gap between the flange section and the film winding section is widened, as described later in detail. The falling-off of the adhesive film may occur not only during the winding of the adhesive film but also during the pulling-out of the adhesive film.

The fallen-off adhesive film not only causes defective external appearance of the film housing body, but also may cause blocking. Here, the blocking of the adhesive film means that the adhesive film is stuck to a constituent element of the film housing body (for example, the flange section, the adhesive film, etc.). The blocking of the adhesive film causes pulling-out failure, a defect of the adhesive layer, etc.

In particular, from the viewpoint of suppressing the blocking of the adhesive film, a large tension cannot be applied to the adhesive film during the winding of the adhesive film. This is because, if a large tension is applied to the adhesive film during the winding of the adhesive film, the adhesive layer protrudes from the adhesive film and is stuck to another adhesive film or the flange section (that is, blocking occurs). Thus, in conventional reel members, the adhesive film is likely to move on the film winding section. The falling-off of the adhesive film is likely to occur also in such a respect.

In addition, these days, there are needs that the adhesive film to be wound around the reel member be made as long as possible from the viewpoints of cost reduction etc. However, the longer the adhesive film is, the larger the outer diameter of the flange section needs to be made. Then, the larger the outer diameter of the flange section is, the more likely surface runout is to occur and the larger the amount of surface runout tends to be. Hence, the longer the adhesive film is, the more likely the falling-off of the adhesive film is to occur.

In order to make the adhesive film to be wound around the reel member longer while suppressing the increase in the outer diameter of the flange section, winding the adhesive film around the winding core section in a traverse manner is proposed. However, in the technology of winding the adhesive film around the winding core section in a traverse manner, the falling-off of the adhesive film is likely to occur in an end portion of the film winding section. Therefore, the problem of the falling-off of the adhesive film cannot be fundamentally solved.

As a method for suppressing the falling-off of the adhesive film, a method of winding the adhesive film around the winding core section and then attaching the flange section to the winding core section is proposed. However, in this method, the manufacturing cost of the film housing body is increased. Furthermore, the structure of the film housing body itself is complicated, and hence the handleability of the film housing body is reduced. Furthermore, this method cannot suppress the falling-off of the adhesive film during the pulling-out of the adhesive film. Therefore, this method does not fundamentally solve the problem of the falling-off of the adhesive film.

Thus, conventional reel members have had a problem that there is a case where the amount of surface runout is large. In the case where an adhesive film is wound around a reel member with a large amount of surface runout, there has been a problem that the adhesive film is likely to fall off. Hence, thus far, in order to prevent the falling-off of the adhesive film, it has been necessary to perform the winding and the pulling-out of the adhesive film very carefully.

Consequently, there has also been another problem that the manipulability of the winding and the pulling-out of the adhesive film is reduced.

Thus, the present invention has been made in view of the problems mentioned above, and an object of the present invention is to provide a new and improved reel member, a new and improved film housing body, and a new and improved method for manufacturing a reel member that can suppress surface runout and accordingly suppress the falling-off of an adhesive film.

Solution to Problem

In order to solve the above problem, according to an aspect of the present invention, there is provided a reel member including: a winding core section around which an adhesive film is windable; and a flange section provided on each of both end portions in a direction of a rotation axis of the winding core section, in which the winding core section and the flange section are provided separately from each other, and an amount of surface runout of the flange section is a value within a range of ±0.2 mm.

Here, a diameter of the winding core section and a diameter of the flange section may satisfy Mathematical Formula (1-1) below, $$D/F \geq 0.005*F-0.38 \quad (1\text{-}1),$$

where D represents the diameter of the winding core section, and F represents the diameter of the flange section.

Further, a sticking surface to which the flange section is stuck may be formed in each of both end portions in the direction of the rotation axis of the winding core section.

Further, the sticking surface may be subjected to smoothing treatment.

Further, the flange section may be fixed to the sticking surface by a sticking member.

Further, a concavity formed in each of both end portions in the direction of the rotation axis of the winding core section may be included, and the sticking surface may be placed around the concavity.

Further, a ratio of a width of the sticking surface to a diameter of the concavity may be less than or equal to 1.0.

Further, a ratio of a depth of the concavity to a distance between bottom surfaces of the concavities may be more than or equal to 0.12.

Further, material removal sections may be formed in a bottom surface of the concavity.

Further, the material removal sections may be placed in positions symmetrical with respect to the rotation axis of the winding core section.

According to another aspect of the present invention, there is provided a reel member including: a winding core section around which an adhesive film is windable; and a flange section provided on each of both end portions in a direction of a rotation axis of the winding core section, in which at least one or more of the winding core section and the two flange sections are a molded product, and an amount of surface runout of each of the flange sections is a value within a range of ±0.2 mm.

Here, at least one flange section of the two flange sections may be molded integrally with the winding core section.

Further, a diameter of the winding core section and a diameter of the flange section may satisfy Mathematical Formula (2-1) below, $$D/F \geq 0.005*F-0.38 \quad (2\text{-}1)$$

where D represents the diameter of the winding core section, and F represents the diameter of the flange section.

Further, a concavity formed in each of both end portions in the direction of the rotation axis of the winding core section may be included.

Further, ribs extending radially from the rotation axis of the winding core section may be formed on a bottom surface of the concavity.

Further, the ribs may be placed in positions symmetrical with respect to the rotation axis of the winding core section.

Further, the winding core section may include a plurality of divided winding core sections linked in the direction of the rotation axis of the winding core section.

Further, a distance between the flange sections may be more than or equal to 10 mm.

Further, a diameter of the winding core section may be more than or equal to 40 mm.

Further, a diameter of the flange section may be more than or equal to 135 mm.

According to another aspect of the present invention, there is provided a film housing body including: the reel member according to any one of claims 1 to 20; and an adhesive film wound around the winding core section.

According to another aspect of the present invention, there is provided a method for manufacturing a reel member including: a step of producing one or a plurality of molded products that form a part or a whole of a reel member including a winding core section around which an adhesive film is windable, and a flange section provided on each of both end portions of the winding core section; and a step of sticking the molded products together to produce the reel member in a case where the molded product forms a part of the reel member.

Advantageous Effects of Invention

As described above, according to the present invention, the amount of surface runout is a value within the range of ±0.2 mm, and therefore it becomes possible to suppress surface runout and accordingly suppress the falling-off of an adhesive film.

DESCRIPTION OF EMBODIMENTS

Figure 1:
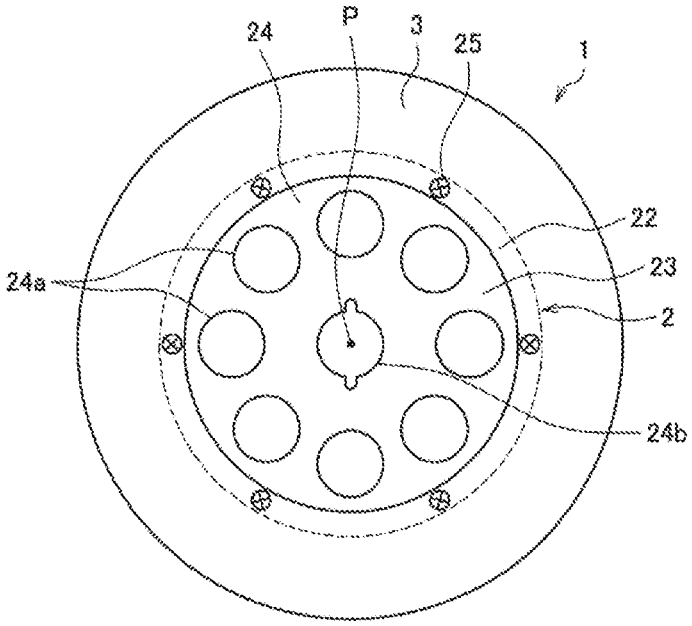
FIG. 1 is a side view showing a configuration of a reel member according to a first embodiment of the present invention.

Hereinafter, (a) preferred embodiment(s) of the present invention will be described in detail with reference to the appended drawings. Note that, in this specification and the appended drawings, structural elements that have substantially the same function and structure are denoted with the same reference numerals, and repeated explanation of these structural elements is omitted.

1. First Embodiment

<1-1. Studies by Present Inventor>

(1-1-1. With Regard to Surface Runout)

The present inventor conducted extensive studies on technology that suppresses surface runout; as a result, has arrived at reel members 1 according to a first embodiment and a second embodiment. Thus, first, surface runout is described in detail. As described above, surface runout means that a flange section sways (warps) in the direction of the rotation axis of a winding core section. The surface runout is categorized into surface runout in the positive direction and surface runout in the negative direction.

Figure 6:
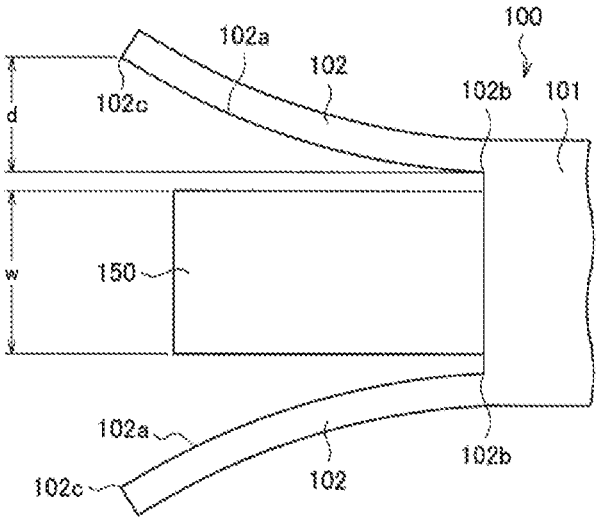
FIG. 6 is a side cross-sectional view showing an example of surface runout in a positive direction.

FIG. 6 shows an example of surface runout in the positive direction. In this example, a flange section 102 of a reel member 100 has developed surface runout in the positive direction. The reel member 100 is an example of the conventional reel member, and includes a winding core section 101 and the flange section 102. An adhesive film is wound around the winding core section 101 in a traverse manner, and thereby a film winding section 150 is formed. The degree of surface runout is expressed as, for example, the amount of surface runout d. The amount of surface runout d is defined (measured) in the following manner. First, a perpendicular line that passes through a contact point 102*b* between the flange section 102 and the winding core section 101 and is perpendicular to the rotation axis of the winding core section 101 is drawn. This perpendicular line is taken as a baseline. Next, a perpendicular line is drawn from the baseline to an outer edge 102*c* of an inner peripheral surface 102*a* of the flange section 102. The length of this perpendicular line is taken as the amount of surface runout d. The amount of surface runout d in the positive direction has a positive value, and the amount of surface runout d in the negative direction has a negative value.

In the case where the flange section 102 has developed surface runout in the positive direction, the thicker the film winding section 150 is (that is, the larger the amount of winding of the adhesive film around the winding core section 101 is), the wider the gap between the film winding section 150 and the flange section 102 is. Hence, the thicker the film winding section 150 is, the more likely the falling-off of the adhesive film is to occur.

As a method for solving this problem, a width w of the film winding section 150 may be made larger as the film winding section 150 becomes thicker. However, in this method, adhesive films wound in both end portions in the width direction of the film winding section 150 are destabilized. Therefore, the adhesive film is still likely to fall off; thus, this method cannot fundamentally solve the problem mentioned above.

The falling-off of the adhesive film may occur during both the winding and the pulling-out of the adhesive film. For example, during the winding of the adhesive film, the longer the time from the start of winding is (that is, the larger the amount of winding is), the more likely the falling-off of the adhesive film is to occur. On the other hand, during the pulling-out of the adhesive film, the shorter the time from the start of pulling-out is (that is, the smaller the amount of pulling-out is), the more likely the falling-off of the adhesive film is to occur. Thus, in the case where the flange section 102 has developed surface runout in the positive direction, the falling-off of the adhesive film is likely to occur.

Figure 7:
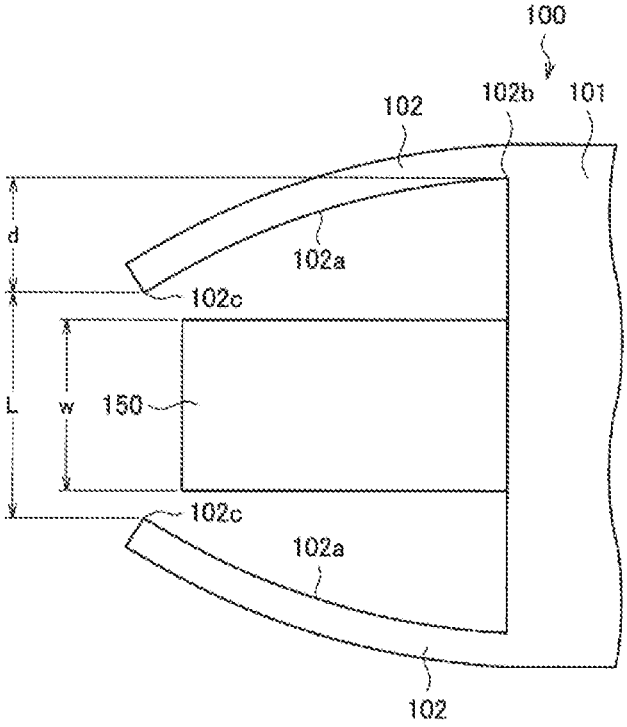
FIG. 7 is a side cross-sectional view showing an example of surface runout in a negative direction.

FIG. 7 shows an example of surface runout in the negative direction. In this example, the flange section 102 of the reel member 100 has developed surface runout in the negative direction. Also in the case where the flange section 102 has developed surface runout in the negative direction, the falling-off of the adhesive film is likely to occur.

Specifically, the width w of the film winding section 150 needs to be set smaller than the minimum value of a distance L between the flange sections 102 (herein, the distance between outer edges 102*c*). This is because, if the adhesive film comes into contact with the flange section 102, the adhesive film may develop blocking.

Therefore, in the case where the film winding section 150 is thin (that is, the amount of winding of the adhesive film around the winding core section is small), the gap between the film winding section 105 and the flange section 102 is large. The thicker the film winding section 150 is, the smaller the gap between the film winding section 150 and the flange section is. This is because the flange section 102 is warped toward the inside in the axial direction of the winding core section 101. Therefore, the falling-off of the adhesive film is likely to occur in the case where the film winding section 150 is thin. Furthermore, in this case, the width w of the film winding section 150 is narrow (that is, the effective use area of the winding core section 101 is small), and hence there arises another problem that the amount of the adhesive film windable around the reel member 100 is small.

The falling-off of the adhesive film may occur during both the winding and the pulling-out of the adhesive film. For example, during the winding of the adhesive film, the shorter the time from the start of winding is (that is, the smaller the amount of winding is), the more likely the falling-off of the adhesive film is to occur. On the other hand, during the pulling-out of the adhesive film, the longer the time from the start of pulling-out is (that is, the larger the amount of pulling-out is), the more likely the falling-off of the adhesive film is to occur. Thus, in the case where the flange section 102 has developed surface runout in the negative direction, the falling-off of the adhesive film is likely to occur.

However, as described above, when manufacturing a reel member, no consideration has so far been given to surface runout. Hence, there has been a case where the amount of surface runout is very large. Therefore, in conventional technologies, the adhesive film has tended to fall off Thus, the present inventor conducted extensive studies on technology for reducing the amount of surface runout; as a result, has arrived at reel members 1 according to a first embodiment and a second embodiment. In the reel members 1 according to the first embodiment and the second embodiment, the amount of surface runout can be suppressed to less than or equal to ±0.2 mm. The first embodiment will now be described.

<1-2. Overall Configuration of Reel Member>

Figure 2:
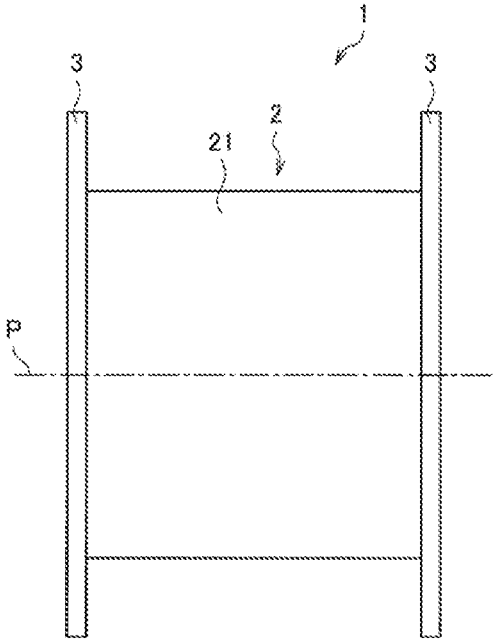
FIG. 2 is a front view of the reel member according to the embodiment.
Figure 3:
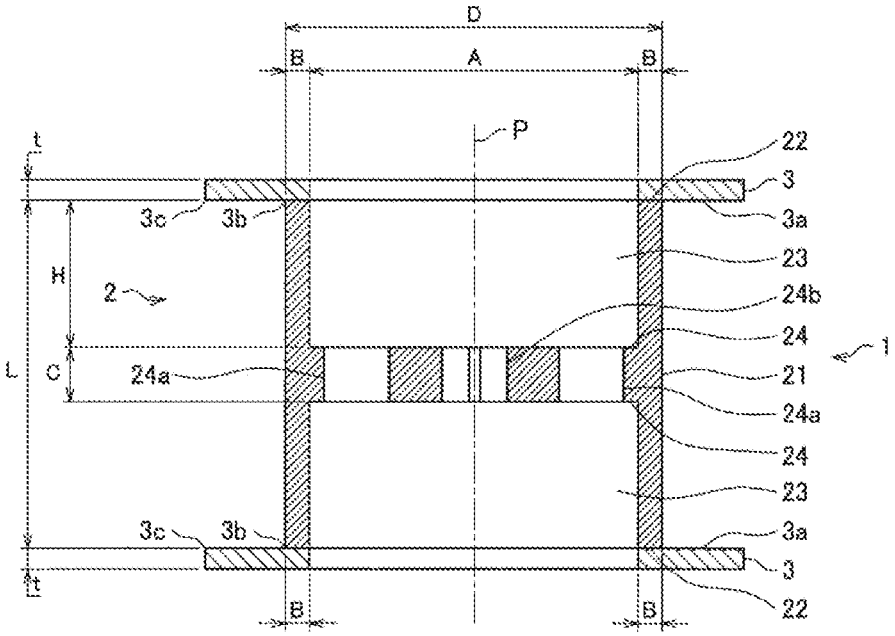
FIG. 3 is a planar cross-sectional view of the reel member.

Next, an overall configuration of the reel member 1 according to the first embodiment is described on the basis of FIG. 1 to FIG. 3.

The reel member 1 includes a winding core section 2, a flange section 3, and a sticking member 25. The winding core section 2 is a member around which an adhesive film is windable. The adhesive film is specifically wound around a peripheral surface 21 of the winding core section 2. A cross-sectional shape perpendicular to the rotation axis P of the winding core section 2 is a circular shape.

A sticking surface 22 and a concavity 23 are formed in each of both end portions in the direction of the rotation axis P of the winding core section 2. The sticking surface 22 is a flat surface substantially perpendicular to the rotation axis P, and the flange section 3 is stuck to the sticking surface 22. Here, the surface of the flange section 3 tends to follow the sticking surface 22. Therefore, the smoother the sticking surface 22 is (that is, the smaller the amounts of unevenness and inclination are), the smoother also the flange section 3 tends to be. For example, even when the flange section 3 is warped in the thickness direction, the warpage is highly likely to be reduced when the flange section 3 is stuck to the sticking surface 22. As a result, the amount of surface runout of the flange section 3 is expected to be reduced.

Hence, it is preferable that the sticking surface 22 have been subjected to smoothing treatment. Here, the smoothing treatment is treatment for making the sticking surface 22 as smooth as possible. Examples of the smoothing treatment include polishing treatment with a lathe processing machine or the like, aging treatment (thermal annealing treatment), etc.

There are no particular limits on the degree to which smoothing treatment is performed. That is, the amount of surface runout of the flange section 3 can be a value within the range of ±0.2 mm by setting each dimension of the reel member 1 to a value within a prescribed range described later and then performing smoothing treatment as appropriate. That is, smoothing treatment may be performed so that the amount of surface runout is a value within the range of ±0.2 mm, as appropriate. Also the amount of surface runout of the present first embodiment is defined similarly to FIG. 6 and FIG. 7. That is, a perpendicular line that passes through a contact point 3*b* between the flange section 3 and the winding core section 2 and is perpendicular to the rotation axis of the winding core section 2 is drawn. Next, a perpendicular line is drawn down from an outer edge 3*c* of an inner peripheral surface 3*a* of the flange section 3 to the baseline. The length of this perpendicular line is taken as the amount of surface runout. In the present first embodiment, the amount of surface runout in the positive direction has a positive value, and the amount of surface runout in the negative direction has a negative value.

The concavity 23 is formed in the winding core section 2 by performing material removal in a circular columnar shape of both each of end portions in the direction of the rotation axis P of the winding core section 2. The center axis of the concavity 23 is coaxial with the rotation axis P of the reel member 1. The sticking surface 22 is formed around the concavity 23. By forming the concavity 23 in the winding core section 2, the weight of the reel member 1 can be reduced. Here, in the processing of pulling out the adhesive film from a film housing body 50 (see FIG. 4) (pulling-out processing), the reel member 1 is frequently stopped and re-rotated. In particular, in the case where a long-length (for example, more than or equal to 600 m) adhesive film is wound around the reel member 1, the numbers of times of stopping and re-rotation are very large. Therefore, if the stopping and re-rotation of the reel member 1 take a long time, working efficiency is significantly reduced. In this respect, in the present first embodiment, the inertial force at the time of stopping or re-rotating the reel member 1 can be reduced by reducing the weight of the reel member 1. Hence, the stopping and re-rotation of the reel member 1 can be performed in a short time. Therefore, pulling-out processing can be performed stably with good efficiency. Furthermore, since the weight of the reel member 1 has been reduced, the pulling-out tension (tension) applied to the adhesive film during pulling-out processing can be reduced. Also in this respect, pulling-out processing can be performed stably with good efficiency.

Material removal sections 24*a* and a through hole for a shaft 24*b* are formed in the bottom surface 24 of the concavity 23. The material removal section 24*a* is a through hole that pierces from the bottom surface 24 of one concavity 23 to the bottom surface 24 of the other concavity 23. However, the material removal section 24*a* does not necessarily need to be a through hole, but may be a recess. By providing the material removal section 24*a* in the winding core section 2, the weight of the reel member 1 can be further reduced.

Here, the positions where the material removal sections 24*a* are provided are not particularly limited, but it is preferable that the material removal sections 24*a* be provided in positions symmetrical with respect to the rotation axis P of the winding core section 2, as shown in FIG. 1. More specifically, it is preferable that the material removal sections 24*a* be provided at equal intervals along the circumferential direction with the rotation axis P as the center. Thereby, the fluctuation in pulling-out tension can be suppressed. That is, in the case where the material removal sections 24*a* are provided in positions asymmetrical with respect to the rotation axis P, there is a possibility that the pulling-out tension fluctuates in accordance with the rotation angle of the reel member 1. However, such fluctuation in pulling-out tension can be suppressed by providing the material removal sections 24*a* in positions symmetrical with respect to the rotation axis P.

Note that, the concavity 23 and the material removal section 24*a* described above may not be provided in the winding core section 2. However, from the viewpoint of weight reduction, the concavity 23 and the material removal section 24*a* are preferably provided in the winding core section 2.

The through hole for a shaft 24*b* is a through hole that a shaft for rotating the reel member 1 pierces and is fixed to.

The flange section 3 is a ring-like and flat plate-like member that is provided separately from the winding core section 2. The flange section 3 is provided on each of both end portions in the direction of the rotation axis P of the winding core section 2. More specifically, the flange section 3 is stuck to the sticking surface 22 by the sticking members 25. The position of sticking by the sticking member 25 is not particularly limited, but it is preferable that the sticking members 25 be provided in positions symmetrical with respect to the rotation axis P, similarly to the material removal sections 24*a* described above. Thereby, the fluctuation in pulling-out tension can be suppressed. The type of the sticking member 25 is not particularly questioned, but the sticking member 25 is preferably a screw or the like, as shown in FIG. 1. Also an adhesive may be used as the sticking member 25. However, the adhesive is preferably applied on the sticking surface 22 uniformly to the extent possible. This is because, if there is variation in the thickness of the application layer, the amount of surface runout of the flange section 3 may be increased.

In the present first embodiment, the sticking surface 22 has been subjected to smoothing treatment, and furthermore each dimension has a value within a prescribed range as described later; thus, the surface runout of the flange section 3 is a value within the range of ±0.2 mm. The surface runout of the flange section 3 is preferably a value within the range of ±0.15 mm, and more preferably a value within the range of ±0.1 mm. Thus, in the present first embodiment, the amount of surface runout of the flange section 3 is very small.

<1-3. Preferred Numerical Value Ranges of Each Dimension>

In the present first embodiment, each dimension related to the reel member 1 is preferably a value within a prescribed range. Each dimension and preferred numerical value ranges will now be described on the basis of FIG. 3.

First, a diameter D of the winding core section 2 and a diameter F of the flange section 3 preferably satisfy Mathematical Formula (1-1) below.

$$D/F \geq 0.005*F-0.38 \quad (1\text{-}1)$$

In the case where the diameter D of the winding core section 2 and the diameter F of the flange section 3 satisfy Mathematical Formula (1-1), the amount of surface runout of the flange section 3 can be a value within the range of ±0.2 mm.

Here, the diameter D of the winding core section 2 and the diameter F of the flange section 3 more preferably satisfy Mathematical Formula (1-2) below.

$$D/F \geq 0.005*F-0.27 \quad (1\text{-}2)$$

In the case where the diameter D of the winding core section 2 and the diameter F of the flange section 3 satisfy Mathematical Formula (1-2), the amount of surface runout of the flange section 3 can be a value within the range of ±0.15 mm.

The diameter D of the winding core section 2 and the diameter F of the flange section 3 still more preferably satisfy Mathematical Formula (1-3) below.

$$D/F \geq 0.005*F-0.14 \quad (1\text{-}3)$$

In the case where the diameter D of the winding core section 2 and the diameter F of the flange section 3 satisfy Mathematical Formula (1-3), the amount of surface runout of the flange section 3 can be a value within the range of ±0.1 mm. A possible reason why Mathematical Formulae (1-1) to (1-3) hold is the following, for example. That is, the larger the diameter F of the flange section 3 is, the larger the amount of surface runout tends to be, and therefore the larger also the diameter D of the winding core section 2 needs to be made accordingly. That is, the larger the diameter F of the flange section 3 is, the larger also D/F needs to be made. Hence, Mathematical Formulae (1-1) to (1-3) hold.

The value of the diameter D itself of the winding core section 2 is not particularly limited, but is preferably more than or equal to 40 mm. This is in order to ensure an area where the adhesive film is wound and accordingly elongate the adhesive film to be wound around the reel member 1. The value of the diameter F itself of the flange section 3 is not particularly limited either, but is preferably more than or equal to 135 mm. This is in order to allow a film winding section 50*a* (see FIG. 4) to be thickened and accordingly elongate the adhesive film to be wound around the reel member 1.

The ratio (B/A) of a width B of the sticking surface 22 to a diameter A of the concavity 23 is preferably less than or equal to 1.0, more preferably less than or equal to 0.25, and still more preferably less than or equal to 0.08. In the case where B/A is less than or equal to 1.0, the amount of surface runout can be a value within the range of ±0.2 mm. In the case where B/A is less than or equal to 0.25, the amount of surface runout can be a value within the range of ±0.15 mm. In the case where B/A is less than or equal to 0.08, the amount of surface runout can be a value within the range of ±0.1 mm.

Here, the width B of the sticking surface 22 refers to the length from the end on the concavity 23 side of the sticking surface 22 to the end on the peripheral surface 21 side of the winding core section 2. The smaller the width B of the sticking surface 22 is, the smaller the contact area between the sticking surface 22 and the flange section 3 is. Thus, the present inventor conducted a study on the width B of the sticking surface 22, and has found that, the smaller the width B of the sticking surface 22 is, that is, the smaller the contact area is, the smaller the amount of surface runout tends to be. The present inventor further conducted a study on the width B of the sticking surface 22, and has found that, in the case where B/A is a value within the ranges mentioned above, the amount of surface runout is reduced. The width B of the sticking surface 22 is preferably smaller also from the viewpoint of weight reduction.

On the other hand, if the width B is too small, the sticking portion of the flange section 3 to the sticking surface 22 may be destabilized. From such a point of view, B/A is preferably more than or equal to 0.05. The width B is preferably more than or equal to 5 mm. This is in order to make it easier to perform the working of fixing the sticking surface 22 and the flange section 3 together.

The ratio (H/C) of a depth H of the concavity 23 to a distance C between the bottom surfaces 24 of the concavities 23 is preferably more than or equal to 0.12, more preferably more than or equal to 0.33, and still more preferably more than or equal to 2.0. In the case where H/C is more than or equal to 0.12, the amount of surface runout can be a value within the range of ±0.2 mm. In the case where H/C is more than or equal to 0.33, the amount of surface runout can be a value within the range of ±0.15 mm. In the case where H/C is more than or equal to 2.0, the amount of surface runout can be a value within the range of ±0.1 mm.

The larger the depth H is, the easier it is for the warpage of the flange section 3 to be absorbed by the winding core section 2. Hence, the amount of surface runout is reduced. Thus, the present inventor conducted a study on the depth H of the concavity 23, and has found that, the larger the depth H of the concavity 23 is, the smaller the amount of surface runout tends to be. The present inventor further conducted a study on the depth H, and has found that, in the case where H/C is a value within the ranges mentioned above, the amount of surface runout is reduced. The value of the depth H is preferably larger also from the viewpoint of weight reduction.

On the other hand, if the depth H is too large, the distance C between the bottom surfaces 24 is too small, and therefore it is difficult to fix the reel member 1 to a shaft (a shaft for rotating the reel member 1). From such a point of view, H/C is preferably less than or equal to 3.0.

A distance L between the flange sections 3 (=2*H+C) is not particularly limited, but is preferably more than or equal to 10 mm, and more preferably more than or equal to 50 mm. This is in order to ensure an area where the adhesive film is wound and accordingly elongate the adhesive film to be wound around the reel member 1.

The ratio (t/F) of a thickness t of the flange section 3 to the diameter F of the flange section 3 is preferably less than or equal to 0.05 because in this case the amount of surface runout can be a value within the range of less than or equal to ±0.2 mm, and more preferably less than or equal to 0.025 because in this case the amount of surface runout can be a value within the range of less than or equal to ±0.15 mm. From the viewpoints of strength and durability, t/F is preferably more than or equal to 0.01.

<1-4. Material of Winding Core Section and Flange Section>

The material of the winding core section 2 and the flange section 3 is not particularly limited. Examples of the material of the winding core section 2 and the flange section 3 include a thermoplastic resin and the like. Here, the thermoplastic resin may be a general-purpose resin, and may also be a general-purpose engineering plastic, a super engineering plastic, or the like. The thermoplastic resin may be a crystalline resin or an amorphous resin. Examples of the general-purpose resin include polyethylene, polypropylene, polystyrene, and the like. Examples of the general-purpose engineering plastic include a polycarbonate, a polyamide, and the like. Examples of the super engineering plastic include a polyimide, a polyamide-imide, and the like. An amorphous resin is preferable in terms of dimensional accuracy being obtained with good reproducibility.

The manufacturing cost of a reel member around which an adhesive film is windable in a traverse manner tends to be high because the reel member is required to have high dimensional accuracy etc. Hence, such a reel member is required to have recyclability. Also the reel member 1 according to the present first embodiment is a reel member around which an adhesive film is windable in a traverse manner. Therefore, the reel member 1 preferably has high recyclability. Hence, the material of the winding core section 2 and the flange section 3 is preferably a polycarbonate. Polycarbonates have strong solvent resistance, particularly to ethanol. In addition, polycarbonates are excellent also in impact resistance. Therefore, a reel member 1 formed of a polycarbonate can be cleaned with ethanol after use, and is less likely to be damaged during carrying. Therefore, the reel member 1 formed of a polycarbonate has high recyclability. The winding core section 2 and the flange section 3 may also be formed of a resin that has solvent resistance, impact resistance, and specific gravity similar to a polycarbonate. Also in this case, similar effects are obtained. Further, any material other than resins, such as a metal, has no particular problem to the extent that equal or greater properties in terms of dimensional accuracy and handleability are obtained in the above manner.

<1-5. Configuration of Film Housing Body>

Figure 4:
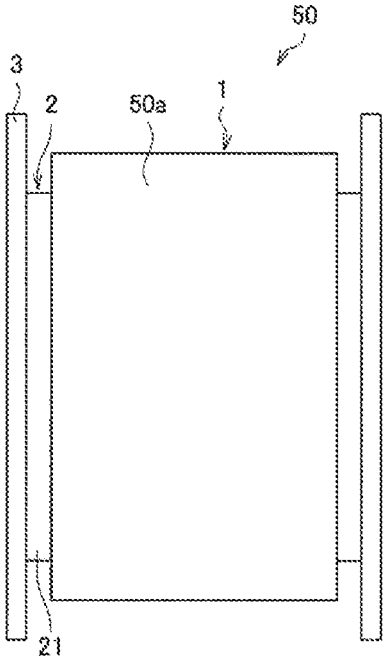
FIG. 4 is a front view of a film housing body (a body in which a film is wound around the reel member).

Next, the configuration of the film housing body 50 using the reel member 1 is described on the basis of FIG. 4. The film housing body 50 includes the reel member 1 and the film winding section 50*a*. The film winding section 50*a* is formed by winding an adhesive film around the peripheral surface 21 of the winding core section 2 in a traverse manner. The adhesive film may not be wound in a traverse manner. In the present first embodiment, since the amount of surface runout of the flange section 3 is a value within the range of ±0.2 mm, the falling-off of the adhesive film is less likely to occur during both the winding and the pulling-out of the adhesive film.

The adhesive film that can be used in the present first embodiment is not particularly limited. The adhesive film is composed of, for example, a matrix film and an adhesive layer stacked in a form of a matrix film. The material of the matrix film is not particularly limited, and may be determined in accordance with the use of the adhesive film, as appropriate. Examples of the material that forms the matrix film include a material in which polyethylene terephthalate (PET), oriented polypropylene (OPP), poly-4-methylpentene-1 (PMP), polytetrafluoroethylene (PTFE), or the like is coated with a release agent such as silicone. These matrix films can prevent the drying of the adhesive film, and can maintain the shape of the adhesive film.

The adhesive layer is a layer having adhesiveness, and is formed on the matrix film. The material of the adhesive layer is not particularly limited either, and may be determined in accordance with the use of the adhesive film, as appropriate. For example, the adhesive layer may be an anisotropic electrically conductive material. However, the lowest melt viscosity of the adhesive layer is preferably $1\times10^3$ to $5.0\times10^5$ Pa·s. The width of the adhesive film is preferably 0.6 to 3.0 mm, and the thickness of the adhesive layer is preferably 10 to 50 μm. From the viewpoint of preventing blocking during the pulling-out of the adhesive film, a release film may be further provided on the adhesive layer. The use of the adhesive film according to the present first embodiment is not particularly limited, and may be used for the manufacturing of a solar panel or the like, for example.

The range of the ratio of the distance L between the flange sections 3 to the width of the adhesive film (L/the width of the adhesive film) is not particularly limited, but is preferably more than or equal to 3, more preferably more than or equal to 5, and still more preferably more than or equal to 30. The upper limit value is not particularly limited, and may be set in accordance with the use of the reel member 1 etc., as appropriate. The length of the adhesive film is not particularly questioned; by winding an adhesive film around the reel member 1 in a traverse manner, a longer-length adhesive film is windable around the reel member 1. The length of the adhesive film may be, for example, more than or equal to 600 m. Examples of the method for producing such a long-length adhesive film include a method involving producing a plurality of short adhesive films (for example, approximately 100 m) and linking these plurality of short adhesive films.

<1-6. Method for Manufacturing Reel Member>

Next, a method for manufacturing the reel member 1 is described. The reel member 1 is produced by producing the winding core section 2 and the flange section 3 and sticking these together. The winding core section 2 is produced by the following process.

First, a round rod having a diameter equal to the diameter D of the winding core section 2 is prepared. Next, the round rod is subjected to smoothing treatment. Next, the round rod is roughly cut using a lathe processing machine or the like, and thereby a winding core outer-shape body having a rough outer shape of the winding core section 2 is produced. Next, the winding core outer-shape body is subjected to smoothing treatment. At this stage, the sticking surface 22 becomes smooth. Next, small parts of the winding core outer-shape body are subjected to finishing processing using a lathe processing machine or the like, and thereby the winding core section 2 is produced. Here, each dimension of the winding core section 2 is preferably a value within the ranges described above. It is preferable to perform smoothing treatment multiple times like the above, but it is sufficient to perform smoothing treatment at least on the winding core outer-shape body. Smoothing treatment may be omitted, but the amount of surface runout can be reduced more reliably by performing smoothing treatment.

On the other hand, the flange section 3 is produced by the following process. First, a plate-like member having a thickness equal to the thickness t of the flange section 3 is prepared. Next, the plate-like member is processed using a lathe processing machine (or a milling processing machine) or the like, and thereby the flange section 3 is produced. Here, each dimension of the flange section 3 is preferably a value within the ranges described above.

Next, the flange section 3 is placed on the sticking surface 22 of the winding core section 2, and the flange section 3 is stuck to the winding core section 2 using the sticking member 25. By the above process, the reel member 1 is produced.

2. Second Embodiment

<2-1. Overall Configuration of Reel Member>

Figure 8:
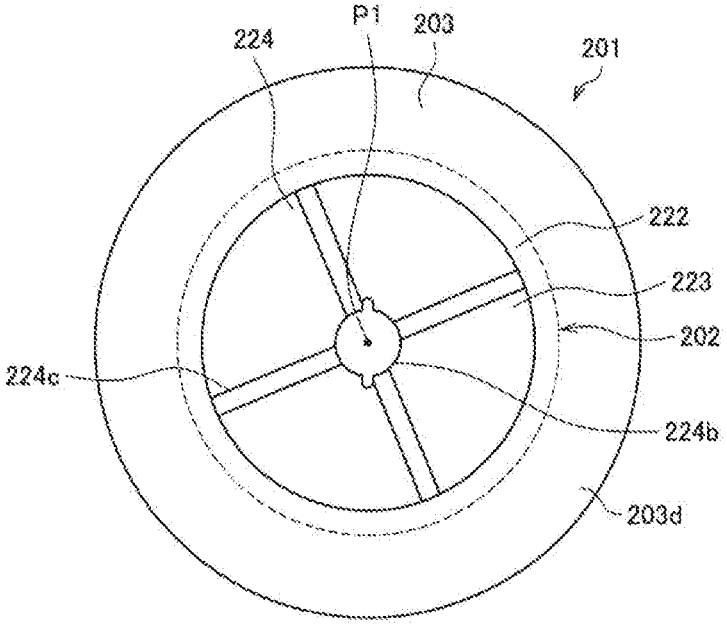
FIG. 8 is a side view showing a configuration of a reel member according to a second embodiment of the present invention.
Figure 9:
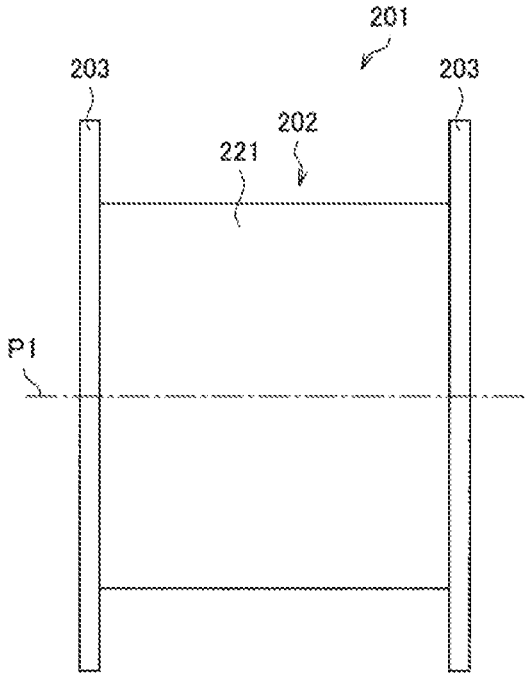
FIG. 9 is a front view of the reel member according to the embodiment.
Figure 10:
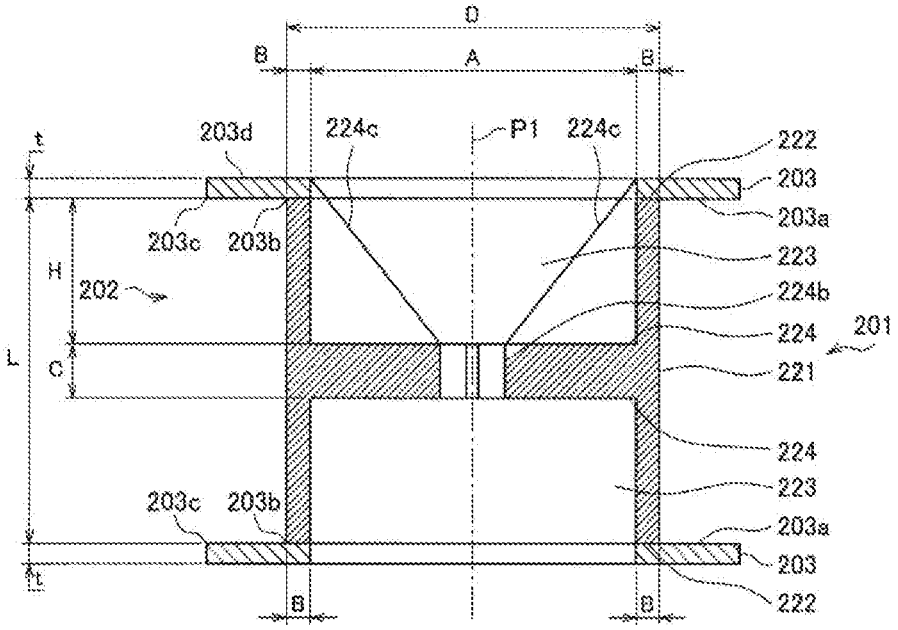
FIG. 10 is a planar cross-sectional view of the reel member.

Next, an overall configuration of a reel member 201 according to the present embodiment is described on the basis of FIG. 8 to FIG. 10.

The reel member 201 includes a winding core section 202, a flange section 203, and ribs 224*c*. The winding core section 202 is a member around which an adhesive film is windable. The adhesive film is specifically wound around a peripheral surface 221 of the winding core section 202. A cross-sectional shape perpendicular to a rotation axis P1 of the winding core section 202 is a circular shape.

A sticking surface 222 and a concavity 223 are formed in each of both end portions in the direction of the rotation axis P1 of the winding core section 202. The sticking surface 222 is a flat surface substantially perpendicular to the rotation axis P1. In the present second embodiment, at least one or more of the winding core section 202 and the two flange sections 203 are a molded product. Here, it is preferable that all these components be a molded product. It is more preferable that at least one flange section 203 of the two flange sections 203 be molded integrally with the winding core section 202. In the case where the flange section 203 and the winding core section 202 are integrally molded, the sticking surface 222 is defined as the boundary surface between the winding core section 202 and the flange section 203. In the case where the winding core section 202 and the flange section 203 are integrally molded, the winding core section 202 and the flange section 203 are molded by injection molding using a mold as described later, and therefore the shape of the flange section 203 is stabilized. That is, the amount of surface runout of the flange section 203 is expected to be reduced. On the other hand, in the case where the winding core section 202 is provided separately from the flange section 203, the sticking surface 222 is defined as the surface to which the flange section 203 is stuck. In the case where the winding core section 202 is provided separately from the flange section 203, the surface of the flange section 203 tends to follow the sticking surface 222. Therefore, the smoother the sticking surface 222 is (that is, the smaller the amounts of unevenness and inclination are), the smoother also the flange section 203 tends to be. For example, even when the flange section 203 is warped in the thickness direction, the warpage is highly likely to be reduced when the flange section 203 is stuck to the sticking surface 222. As a result, the amount of surface runout of the flange section 203 is expected to be reduced.

Hence, it is preferable that the sticking surface 222 have been subjected to smoothing treatment. Here, the smoothing treatment is treatment for making the sticking surface 222 as smooth as possible. Examples of the smoothing treatment include polishing treatment with a lathe processing machine or the like, aging treatment (thermal annealing treatment), etc.

There are no particular limits on the degree to which smoothing treatment is performed. That is, the amount of surface runout of the flange section 203 can be a value within the range of ±0.2 mm by setting each dimension of the reel member 201 to a value within a prescribed range and then performing smoothing treatment as appropriate. That is, smoothing treatment may be performed so that the amount of surface runout is a value within the range of ±0.2 mm, as appropriate. Also the amount of surface runout of the present second embodiment is defined similarly to FIG. 6 and FIG. 7. That is, a perpendicular line that passes through a contact point 203*b* between the flange section 203 and the winding core section 202 and is perpendicular to the rotation axis of the winding core section 202 is drawn. Next, a perpendicular line is drawn down from an outer edge 203*c* of an inner peripheral surface 203*a* of the flange section 203 to the baseline. The length of this perpendicular line is taken as the amount of surface runout. In the present second embodiment, the amount of surface runout in the positive direction has a positive value, and the amount of surface runout in the negative direction has a negative value.

The method for sticking the flange section 203 to the winding core section 202 is not particularly limited, and ultrasonic welding and impulse welding are preferable, and ultrasonic welding is more preferable, for example. By using these methods, the flange section 203 can be strongly stuck to the winding core section 202 while the amount of surface runout of the flange section 203 is suppressed. Impulse welding is performed by the following method, for example. That is, a plurality of protruding portions (male portions) are provided on the sticking surface 222 (corresponding through holes are provided in the flange section 203). Here, the protruding portion is longer than the thickness of the flange section 203. Further, it is preferable that the protruding portions be provided in positions symmetrical with respect to the rotation axis P1 of the winding core section 202. Specifically, it is preferable that the protruding portions be provided at equal intervals along the round direction of the sticking surface 222. Thereby, welding spots (spots where the protruding portion and the through hole are integrated) are provided at equal intervals along the round direction of the sticking surface 222, and therefore the shape of the reel member 201 can be stabilized more. Furthermore, the fluctuation in pulling-out tension can be suppressed.

On the other hand, through holes are formed in portions of the inner peripheral surface 203*a* of the flange section 203 that are to be in contact with the sticking surface 222. The through hole pierces the flange section 203 in the thickness direction. Further, the through hole is provided in a position facing the protruding portion. Then, the protruding portion is passed through the through hole. Then, a part of the protruding portion protruding from the through hole is melted and solidified. At this time, the melted material not only fills the through hole but also spreads a little up to on an outer peripheral surface 203*d* of the flange section 203; thereby, the through hole is sealed almost completely. Thus, the protruding portion and the through hole are integrated. The above process sticks the flange section 203 to the winding core section 202.

The concavity 223 is formed in each of both end portions in the direction of the rotation axis P1 of the winding core section 202. The concavity 223 is in a circular columnar shape, and the center axis of the concavity 223 is coaxial with the rotation axis P1 of the reel member 201. The sticking surface 222 is formed around the concavity 223. By forming the concavity 223 in the winding core section 202, the weight of the reel member 201 can be reduced. Here, in the processing of pulling out the adhesive film from a film housing body 250 (see FIG. 11) (pulling-out processing), the reel member 201 is frequently stopped and re-rotated. In particular, in the case where a long-length (for example, more than or equal to 600 m) adhesive film is wound around the reel member 201, the numbers of times of stopping and re-rotation are very large. Therefore, if the stopping and re-rotation of the reel member 201 take a long time, working efficiency is significantly reduced. In this respect, in the present second embodiment, the inertial force at the time of stopping or re-rotating the reel member 201 can be reduced by reducing the weight of the reel member 201. Hence, the stopping and re-rotation of the reel member 201 can be performed in a short time. Therefore, pulling-out processing can be performed stably with good efficiency. Furthermore, since the weight of the reel member 201 has been reduced, the pulling-out tension applied to the adhesive film during pulling-out processing can be reduced. Also in this respect, pulling-out processing can be performed stably with good efficiency.

A through hole for a shaft 224*b* and the ribs 224*c* are formed at the bottom surface 224 of the concavity 223. The through hole for a shaft 224*b* is a through hole that a shaft for rotating the reel member 201 pierces and is fixed to.

A plurality of ribs 224*c* are provided on the bottom surface 224 of the concavity 223. By providing the plurality of ribs 224*c* in the winding core section 202, the shape of the reel member 201 can be stabilized, and consequently the amount of surface runout can be reduced.

The ribs 224*c* are plate-like members extending radially from the rotation axis P1 of the winding core section 202, and are molded integrally with the winding core section 202. The upper end surface of the rib 224*c* is inclined, and links the through hole for a shaft 224*b* and an inner edge portion of the flange section 203.

The installation position of the rib 224*c* is not particularly limited, but it is preferable that the ribs 224*c* be provided in positions symmetrical with respect to the rotation axis P1 of the winding core section 202, as shown in FIG. 8. More specifically, it is preferable that the ribs 224*c* be provided at equal intervals along the circumferential direction with the rotation axis P1 as the center. Thereby, the shape of the reel member 201 can be stabilized more. Furthermore, the fluctuation in pulling-out tension can be suppressed. That is, in the case where the ribs 224*c* are provided in positions asymmetrical with respect to the rotation axis P1, there is a possibility that the pulling-out tension fluctuates in accordance with the rotation angle of the reel member 201. However, such fluctuation in pulling-out tension can be suppressed by providing the ribs 224*c* in positions symmetrical with respect to the rotation axis P1.

The number of ribs 224*c* is not particularly limited either; but if the number of ribs 224*c* is too small, the effect of stabilizing the shape of the reel member 201 is not sufficiently obtained. On the other hand, if the number of ribs 224*c* is too large, it may be difficult to take out a mold from the winding core section 202 during molding. Furthermore, there is a possibility that the amount of stored heat of the ribs 224*c* is large after molding. In this case, there is a possibility that, when heat of the rib 224*c* is dissipated, the shape of the rib 224*c* is warped. Such shape warpage may be a factor in the increase in the amount of surface runout. From these points of view, the number of ribs 224*c* is preferably approximately 3 to 16, and more preferably approximately 5 to 8.

The concavity 223 and the rib 224*c* described above may not be provided in the winding core section 202. However, from the viewpoints of weight reduction and the shape stabilization of the reel member 201, the concavity 223 and the rib 224*c* are preferably provided in the winding core section 202.

On the other hand, from the viewpoint of achieving further weight reduction, material removal sections may be formed in the bottom surface 224 of the concavity 223. The material removal section is, for example, a through hole piercing between the bottom surfaces 224, or a recess formed on the bottom surface 224. By providing the material removal sections in the winding core section 202, the weight of the reel member 201 can be further reduced.

Here, the position where the material removal section is provided is not particularly limited, but it is preferable that the material removal sections be provided in positions symmetrical with respect to the rotation axis P1 of the winding core section 202. More specifically, it is preferable that the material removal sections be provided at equal intervals along the circumferential direction with the rotation axis P1 as the center. Thereby, the fluctuation in pulling-out tension can be suppressed. That is, in the case where the material removal sections are provided in positions asymmetrical with respect to the rotation axis P1, there is a possibility that the pulling-out tension fluctuates in accordance with the rotation angle of the reel member 201. However, such fluctuation in pulling-out tension can be suppressed by providing the material removal sections in positions symmetrical with respect to the rotation axis P1.

The flange section 203 is a ring-like and flat plate-like member. The flange section 203 is provided on each of both end portions in the direction of the rotation axis P1 of the winding core section 202. It is preferable that at least one of the two flange sections 203 be molded integrally with the winding core section 202. In the present second embodiment, since the flange section 203 is molded integrally with the winding core section 202 and each dimension is a value within a prescribed range as described later, the surface runout of the flange section 203 is a value within the range of ±0.2 mm. Even when both of the two flange sections 203 are provided separately from the winding core section 202, the surface runout of the flange section 203 can be a value within the range of ±0.2 mm as described later, as a matter of course.

On the other hand, in the case where the flange section 203 is provided separately from the winding core section 202, the flange section 203 is stuck to the winding core section 202 by some kind of sticking method (for example, ultrasonic welding).

In the present second embodiment, the sticking surface 222 has been subjected to smoothing treatment, and furthermore each dimension is a value within a prescribed range as described later; thus, the surface runout of the flange section 203 is a value within the range of ±0.2 mm. The surface runout of the flange section 203 is preferably a value within the range of ±0.15 mm, and more preferably a value within the range of ±0.1 mm.

The flange section 203 may be stuck to the winding core section 202 also by an adhesive. However, the adhesive is preferably applied on the sticking surface 222 uniformly to the extent possible. This is because, if there is variation in the thickness of the application layer, the amount of surface runout of the flange section 203 may be increased.

<2-2. Preferred Numerical Value Ranges of Each Dimension>

In the present second embodiment, each dimension related to the reel member 201 is preferably a value within a prescribed range. Each dimension and preferred numerical value ranges will now be described on the basis of FIG. 10.

First, a diameter D of the winding core section 202 and a diameter F of the flange section 203 preferably satisfy Mathematical Formula (2-1) below.

$$D/F \geq 0.005*F-0.38 \quad (2\text{-}1)$$

In the case where the diameter D of the winding core section 202 and the diameter F of the flange section 203 satisfy Mathematical Formula (2-1), the amount of surface runout of the flange section 203 can be a value within the range of ±0.2 mm.

Here, the diameter D of the winding core section 202 and the diameter F of the flange section 203 more preferably satisfy Mathematical Formula (2-2) below.

$$D/F \geq 0.005*F-0.27 \quad (2\text{-}2)$$

In the case where the diameter D of the winding core section 202 and the diameter F of the flange section 203 satisfy Mathematical Formula (2-2), the amount of surface runout of the flange section 203 can be a value within the range of ±0.15 mm.

The diameter D of the winding core section 202 and the diameter F of the flange section 203 still more preferably satisfy Mathematical Formula (2-3) below.

$$D/F \geq 0.005*F-0.14 \quad (2\text{-}3)$$

In the case where the diameter D of the winding core section 202 and the diameter F of the flange section 203 satisfy Mathematical Formula (2-3), the amount of surface runout of the flange section 203 can be a value within the range of ±0.1 mm. A possible reason why Mathematical Formulae (2-1) to (2-3) hold is the following, for example. That is, the larger the diameter F of the flange section 203 is, the larger the amount of surface runout tends to be, and therefore the larger also the diameter D of the winding core section 202 needs to be made accordingly. That is, the larger the diameter F of the flange section 203 is, the larger also D/F needs to be made. Hence, Mathematical Formulae (2-1) to (2-3) hold.

The value of the diameter D itself of the winding core section 202 is not particularly limited, but is preferably more than or equal to 40 mm. This is in order to ensure an area where the adhesive film is wound and accordingly elongate the adhesive film to be wound around the reel member 201. The value of the diameter F itself of the flange section 203 is not particularly limited either, but is preferably more than or equal to 135 mm. This is in order to allow a film winding section 250*a* (see FIG. 11) to be thickened and accordingly elongate the adhesive film to be wound around the reel member 201.

A diameter A of the concavity 223 is preferably approximately 100 to 130 mm in order to perform molding stably. A width B of the sticking surface 222 is preferably approximately 1 to 4 mm in order to perform molding stably. Here, the width B of the sticking surface 222 refers to the length from the end on the concavity 223 side of the sticking surface 222 to the end on the peripheral surface 221 side of the winding core section 202. A depth H of the concavity 223 is preferably approximately 15 to 30 mm in order to provide the rib stably. A distance C between the bottom surfaces 224 is preferably approximately 5 to 15 mm in order to perform molding stably. A distance L between the flange sections 203 (=2*H+C) is not particularly limited, but is preferably more than or equal to 10 mm, and more preferably more than or equal to 50 mm. This is in order to ensure an area where the adhesive film is wound and accordingly elongate the adhesive film to be wound around the reel member 201.

The ratio (t/F) of a thickness t of the flange section 203 to the diameter F of the flange section 203 is preferably less than or equal to 0.05 because in this case the amount of surface runout can be a value within the range of less than or equal to ±0.2 mm, and more preferably less than or equal to 0.025 because in this case the amount of surface runout can be a value within the range of less than or equal to ±0.15 mm. From the viewpoints of strength and durability, t/F is preferably more than or equal to 0.01.

<2-3. Material of Winding Core Section and Flange Section>

Examples of the material of the winding core section 202 and the flange section 203 include a thermoplastic resin and the like. Here, the thermoplastic resin may be a general-purpose resin, and may also be a general-purpose engineering plastic, a super engineering plastic, or the like. The thermoplastic resin may be a crystalline resin or an amorphous resin. Examples of the general-purpose resin include polyethylene, polypropylene, polystyrene, and the like. Examples of the general-purpose engineering plastic include a polycarbonate, a polyamide, and the like. Examples of the super engineering plastic include a polyimide, a polyamide-imide, and the like. An amorphous resin is preferable in terms of dimensional accuracy being obtained with good reproducibility.

The manufacturing cost of a reel member around which an adhesive film is windable in a traverse manner tends to be high because the reel member is required to have high dimensional accuracy etc. Hence, such a reel member is required to have recyclability. Also the reel member 201 according to the present second embodiment is a reel member around which an adhesive film is windable in a traverse manner. Therefore, the reel member 201 preferably has high recyclability. Hence, the material of the winding core section 202 and the flange section 203 is preferably a polycarbonate. Polycarbonates have strong solvent resistance, particularly to ethanol. In addition, polycarbonates are excellent also in impact resistance. Therefore, a reel member 201 formed of a polycarbonate can be cleaned with ethanol after use, and is less likely to be damaged during carrying. Therefore, the reel member 201 formed of a polycarbonate has high recyclability. The winding core section 202 and the flange section 203 may also be formed of a resin that has solvent resistance, impact resistance, and specific gravity similar to a polycarbonate. Also in this case, similar effects are obtained.

<2-4. Configuration of Film Housing Body>

Figure 11:
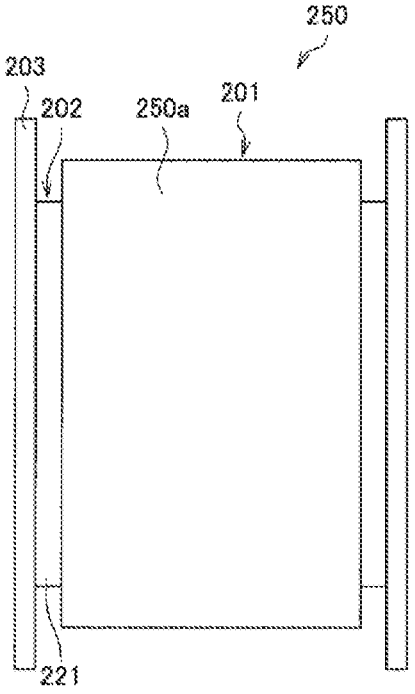
FIG. 11 is a front view of a film housing body (a body in which a film is wound around the reel member).

Next, the configuration of the film housing body 250 using the reel member 201 is described on the basis of FIG. 11. The film housing body 250 includes the reel member 201 and the film winding section 250*a*. The film winding section 250*a* is formed by winding an adhesive film around the peripheral surface 221 of the winding core section 202 in a traverse manner. The adhesive film may not be wound in a traverse manner. In the present second embodiment, since the amount of surface runout of the flange section 203 is a value within the range of ±0.2 mm, the falling-off of the adhesive film is less likely to occur during both the winding and the pulling-out of the adhesive film.

The adhesive film that can be used in the present second embodiment is not particularly limited. The adhesive film is composed of, for example, a matrix film and an adhesive layer stacked in a form of a matrix film. The material of the matrix film is not particularly limited, and may be determined in accordance with the use of the adhesive film, as appropriate. Examples of the material that forms the matrix film include a material in which polyethylene terephthalate (PET), oriented polypropylene (OPP), poly-4-methylpentene-1 (PMP), polytetrafluoroethylene (PTFE), or the like is coated with a release agent such as silicone. These matrix films can prevent the drying of the adhesive film, and can maintain the shape of the adhesive film.

The adhesive layer is a layer having adhesiveness, and is formed on the matrix film. The material of the adhesive layer is not particularly limited either, and may be determined in accordance with the use of the adhesive film, as appropriate. For example, the adhesive layer may be an anisotropic electrically conductive material. However, the lowest melt viscosity of the adhesive layer is preferably $1\times10^3$ to $5.0\times10^5$ Pa·s. The width of the adhesive film is preferably 0.6 to 3.0 mm, and the thickness of the adhesive layer is preferably 10 to 50 μm. From the viewpoint of preventing blocking during the pulling-out of the adhesive film, a release film may be further provided on the adhesive layer. The use of the adhesive film according to the present second embodiment is not particularly limited, and may be used for the manufacturing of a solar panel or the like, for example.

The range of the ratio of the distance L between the flange sections 203 to the width of the adhesive film (L/the width of the adhesive film) is not particularly limited, but is preferably more than or equal to 3, more preferably more than or equal to 5, and still more preferably more than or equal to 30. The upper limit value is not particularly limited, and may be set in accordance with the use of the reel member 201 etc., as appropriate. The length of the adhesive film is not particularly questioned; by winding an adhesive film around the reel member 201 in a traverse manner, a longer-length adhesive film is windable around the reel member 201. The length of the adhesive film may be, for example, more than or equal to 600 m. Examples of the method for producing such a long-length adhesive film include a method involving producing a plurality of short adhesive films (for example, approximately 100 m) and linking these plurality of short adhesive films.

<2-5. Methods for Manufacturing Reel Member>

Next, methods for manufacturing the reel member 201 are described. A method for manufacturing the reel member 201 roughly includes a step of producing a molded product that forms a part or the whole of the reel member 201 and a step of sticking molded products together to produce the reel member 201 in the case where the molded product forms a part of the reel member 201. Specifically, the reel member 201 is produced by injection molding using a mold. Examples of the injection molding will now be described on the basis of FIG. 12A to FIG. 12D.

Figure 12A:
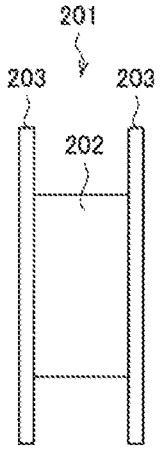
FIG. 12A is an explanatory diagram showing an overview of a method for manufacturing a reel member according to the second embodiment.
Figure 13:
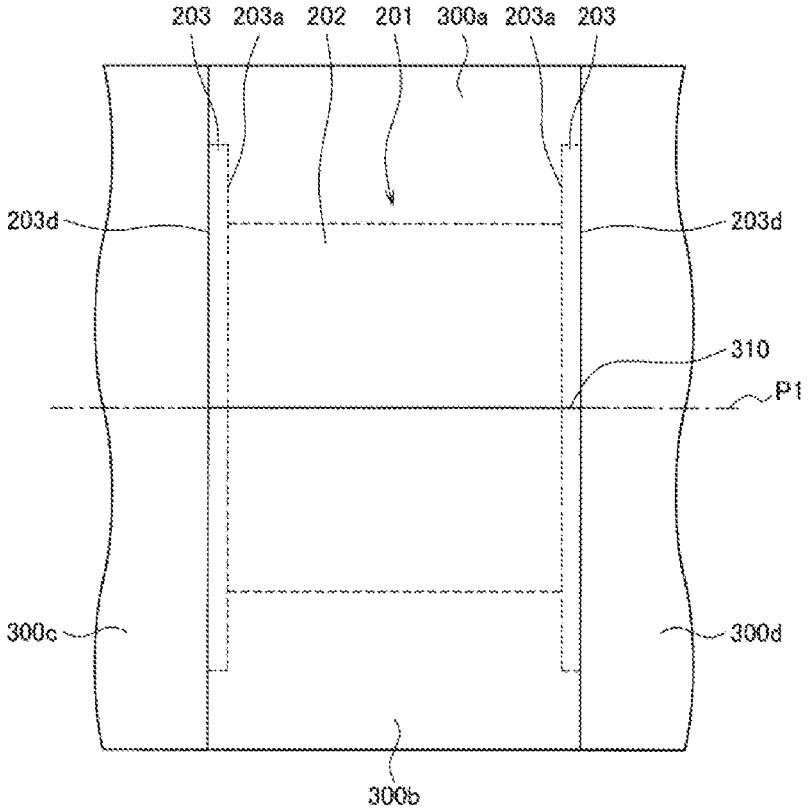
FIG. 13 is an explanatory diagram showing a mold for producing an integrally molded body of a whole reel member (what is called a one-piece molded body).

FIG. 12A shows an example in which the whole reel member 201 is integrally molded using a mold. In this example, an integrally molded product (what is called a one-piece molded body) of the whole reel member 201 is produced. An example of the mold is shown in FIG. 13. In the example shown in FIG. 13, the reel member 201 is molded by molds 300*a* to 300*d*. The molds 300*a* and 300*b* are molds for molding at least the winding core section 202 and the inner peripheral surface 203*a* of the flange section 203, and have a shape symmetrical with respect to the rotation axis P1 of the winding core section 202. The molds 300*a* and 300*b* can move in a direction perpendicular to the rotation axis P1 of the winding core section 202. However, a space 310, although only a little, is formed between the molds 300*a* and 300*b*. The space 310 is in contact with the inner peripheral surface 203*a* of the flange section 203. The molds 300*c* and 300*d* are molds for molding at least the outer peripheral surface 203*d* of the flange section 203, and can move in the direction of the rotation axis P1. The molds 300*a* to 300*d* are joined to each other during the molding of the reel member 201, and then a molten resin is injected into the internal space formed by the molds 300*a* to 300*d*. Then, the molten resin is hardened (that is, the reel member 201 is molded), and then the molds 300*a* to 300*d* are separated from each other (that is, the reel member 201 is released from the molds 300*a* to 300*d*).

In this example, a large number of molds 300*a* to 300*d* are used, and the shapes of the molds 300*a* and 300*b* are complicated; hence, the releasability of the molds 300*a* to 300*d* is poor. Furthermore, the space 310 formed at the boundary between the molds 300*a* and 300*b* is in contact with the inner peripheral surface 203*a* of the flange section 203. When a molten resin is injected, the molten resin, although only a little, enters the space 310. The molten resin that has entered the space 310 is hardened, and consequently forms a burr. Therefore, there is a case where a burr is formed on the inner peripheral surface 203*a* of the flange section 203. Such a burr may cause similar problems to surface runout in the negative direction.

Thus, the example shown in FIG. 12A is less preferable than other examples from the viewpoints of the accuracy of the reel member 201 and manufacturing cost. As a matter of course, the reel member 201 can be manufactured sufficiently even by using this example.

Figure 12B:
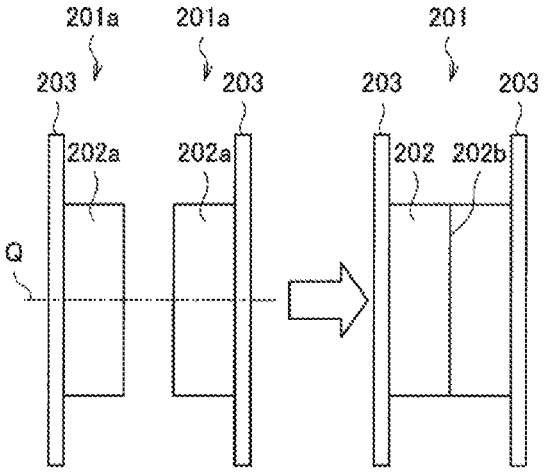
FIG. 12B is an explanatory diagram showing an overview of a method for manufacturing a reel member according to the second embodiment.

In the example shown in FIG. 12B, the reel member 201 is produced by molding two molded products 201*a* and sticking these together. The molded product 201*a* includes a divided winding core section 202*a* around which an adhesive film is windable and the flange section 203 that is molded integrally with one end portion in the direction of a rotation axis Q of the divided winding core section 202*a*. The rotation axis Q coincides with the rotation axis P1 of the winding core section 202. The divided winding core section 202*a* has a shape of one of two pieces of the winding core section 202 that are equally divided in the direction perpendicular to the rotation axis P1. Thus, the concavity 223, the through hole for a shaft 224*b*, and the rib 224*c* described above are formed in the divided winding core section 202*a*. In the reel member 201 produced by this manufacturing method, the winding core section 202 is formed by a plurality of divided winding core sections 202*a* linked in the direction of the rotation axis P1.

Figure 14:
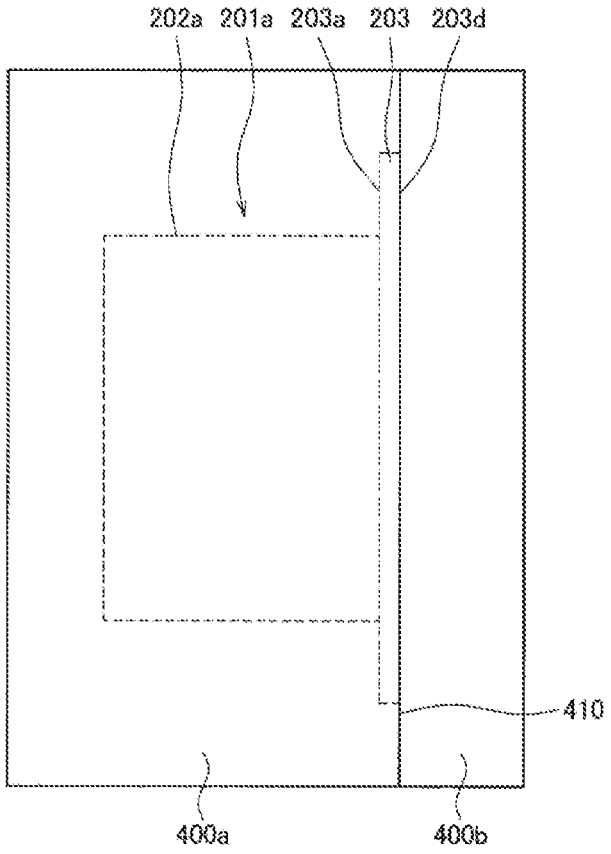
FIG. 14 is an explanatory diagram showing a mold for producing a molded body that forms a part of a reel member (what is called a two-piece molded body).

An example of the mold is shown in FIG. 14. In the example shown in FIG. 14, the molded product 201*a* is molded by molds 400*a* and 400*b*. The mold 400*a* is a mold for molding at least the divided winding core section 202*a* and the inner peripheral surface 203*a* of the flange section 203. The mold 400*a* can move in the direction of the rotation axis P1 of the winding core section 202. The mold 400*b* is a mold for molding at least the outer peripheral surface 203*d* of the flange section 203, and can move in the direction of the rotation axis P1. The molds 400*a* and 400*b* are joined to each other during the molding of the reel member 201, and then a molten resin is injected into the internal space formed by the molds 400*a* and 400*b*. Then, after the molten resin is hardened (that is, the molded product 201*a* is molded), the molds 400*a* and 400*b* are separated from each other (that is, the molded product 201*a* is released from the molds 400*a* and 400*b*).

In this example, a smaller number of molds 400*a* and 400*b* compared to the case of FIG. 12A are used, and the shapes of the molds 400*a* and 400*b* are not significantly complicated; thus, the releasability of the molds 400*a* and 400*b* is good. In order to improve the releasability of the mold 400*a*, a taper may be formed in the divided winding core section 202*a*. The taper has a shape that is inclined toward the rotation axis Q side with distance from the flange section 203. From the viewpoint of the winding accuracy of the adhesive film, the inclination of the taper is preferably as small as possible. A space 410 formed at the boundary between the molds 400*a* and 400*b* is not in contact with the inner peripheral surface 203*a* of the flange section 203, and therefore a burr is not formed on the inner peripheral surface 203*a* of the flange section 203. Furthermore, the number of components that need sticking is as small as two.

Thus, the example shown in FIG. 12B is the most preferred example among the examples shown in FIG. 12A to FIG. 12D from the viewpoints of the accuracy of the reel member 201 and manufacturing cost.

In this example, there is a need to stick the molded products 201*a* together. This sticking is performed by, for example, impulse welding. A method of impulse welding will now be described on the basis of FIG. 15. In this example, a plurality of protruding portions 240*a* and a plurality of through holes 240*b* are formed on an end surface in the direction of the rotation axis Q of the divided winding core section 202*a*. The length of the protruding portion 240*a* is larger than the length of the through hole 240*b*. The through hole 240*b* is a hole that pierces from the end surface of the divided winding core section 202*a* to the bottom surface 224 of the concavity 223. The protruding portions 240*a* and the through holes 240*b* are alternately provided in positions symmetrical with respect to the rotation axis Q. That is, the protruding portions 240*a* and the through holes 240*b* are provided alternately at equal intervals along the round direction of the end surface of the divided winding core section 202*a*. The numbers of protruding portions 240*a* and through holes 240*b* provided are equal to each other. The protruding portion 240*a* and the through hole 240*b* may be provided on the end surface of the divided winding core section 202*a* by injection molding using the molds 400*a* and 400*b* described above. Then, the protruding portion 240*a* provided in one divided winding core section 202*a* is caused to pierce the through hole 240*b* provided in the other divided winding core section 202*a*; on the other hand, the protruding portion 240*a* provided in the other divided winding core section 202*a* is caused to pierce the through hole 240*b* provided in the one divided winding core section 202*a*. After that, a part of the protruding portion 240*a* protruding from the through hole 240*b* is melted and solidified. At this time, the melted material not only fills the through hole 240*b* but also spreads a little on the bottom surface 224 of the concavity 223; thereby, the through hole 240*b* is sealed almost completely. Thus, the protruding portion 240*a* and the through hole 240*b* are integrated. By the above process, the divided winding core sections 202*a* are stuck together. In this example, the protruding portion after solidification protrudes a little from the bottom surface 224 of the concavity 223, but the same number of protruding portions after solidification can be formed symmetrically in each concavity 223. Therefore, the mass balance of the reel member 201 can be equalized. The arrangement of protruding portions 240*a* and through holes 240*b* is not limited to this example, as a matter of course; for example, it is also possible to provide protruding portions 240*a* in one divided winding core section 202*a* and provide through holes 240*b* in the other divided winding core section 202*a*. However, from the viewpoint of equalizing mass balance, the example described above is preferable.

It is preferable not to wind an adhesive film directly around a boundary portion 202*b* between the divided winding core sections 202*a*. For example, it is preferable to first wind a lead tape around this portion and wind an adhesive film on this lead tape.

Figure 12C:
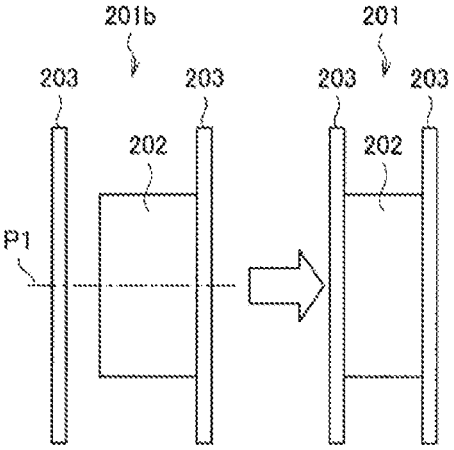
FIG. 12C is an explanatory diagram showing an overview of a method for manufacturing a reel member according to the second embodiment.

In the example shown in FIG. 12C, the reel member 201 is produced by molding a molded product 201*b* and a flange section 203 and sticking these together. The molded product 201*b* includes the winding core section 202 and a flange section 203 that is molded integrally with one end portion in the direction of the rotation axis P1 of the winding core section 202. The molded product 201*b* may be molded by a mold similar to the mold shown in FIG. 14. It is preferable that a taper similar to the taper of the divided winding core section 202*a* be formed in the winding core section 202. The sticking of the flange section 203 and the winding core section 202 may be performed by ultrasonic welding. A specific example of the method is as described above. In this example, a burr does not occur on the inner peripheral surface 203*a* of the flange section 203, and the number of molds for molding the molded product 201*b* is small. Furthermore, the number of components that need sticking is as small as two. However, the releasing of the molded product 201*b* from the mold takes a little time and effort, and hence the accuracy is a little poorer compared to the example shown in FIG. 12B.

Figure 12D:
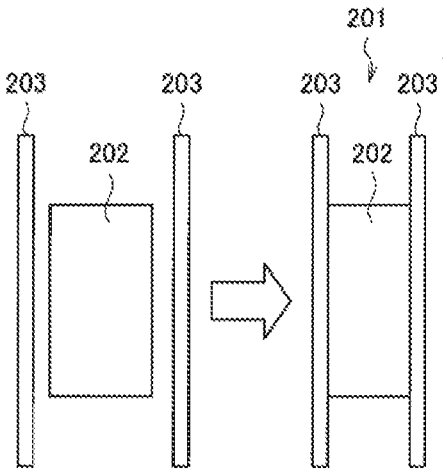
FIG. 12D is an explanatory diagram showing an overview of a method for manufacturing a reel member according to the second embodiment.

In the example shown in FIG. 12D, the reel member 201 is produced by separately molding the two flange sections 203 and the winding core section 202 and sticking these together. In this example, since the two flange sections 203 and the winding core section 202 are separately molded, the two flange sections 203 and the winding core section 202 can be molded with good accuracy. Furthermore, a burr does not occur on the inner peripheral surface 203*a* of the flange section 203. However, the number of components that need sticking is as large as three, and hence the cost is higher compared to the example shown in FIG. 12B.

EXAMPLES

1-1. Example 1-1

Next, Examples of the first embodiment are described. In Example 1-1, the following experiment was conducted.

(1-1. Preparation of Adhesive Film)

An adhesive film including a matrix film made of PET with a width of 1 mm and a thickness of 38 μm, an adhesive layer with a thickness of 20 μm formed on the matrix film, and a release PET film with a thickness of 12 μm formed on the adhesive layer was prepared. The length of the adhesive film was set to 5000 m. Specifically, a plurality of adhesive films of approximately 100 m were produced, and these were linked; thereby, an adhesive film of 5000 m was produced.

Here, the adhesive layer was produced by the following process. Specifically, an adhesive composition containing 30 parts by mass of a phenoxy resin (YP-50, manufactured by Nippon Steel Chemical Co., Ltd.), 20 parts by mass of a liquid epoxy resin (JER828, manufactured by Mitsubishi Chemical Corporation), 10 parts by mass of a rubber component (SG80H, manufactured by Nagase ChemteX Corporation), 40 parts by mass of a hardening agent (Novacure 3941HP, manufactured by Asahi Kasei Corporation), and 1 part by mass of a silane coupling agent (A-187, manufactured by Momentive Performance Materials Inc.) was prepared.

Then, the adhesive composition was dissolved in solvent toluene to prepare an application liquid, and the application liquid was applied on the matrix film. Then, the application layer was heated at 50° C. for 10 minutes to volatilize the solvent. By the above process, the adhesive layer was produced. The lowest melt viscosity of the adhesive layer was 7.0×103 Pa·s. The lowest melt viscosity of the adhesive layer is a value measured using a rotary rheometer (manufactured by TA Instruments, Inc.). The measurement was performed using a measuring plate with a diameter of 8 mm while the rate of temperature increase was set constant at 10° C./minute and the force during measurement was set constant at 1 N.

(1-2. Production of Reel Member)

A reel member 1 was produced by the following process. First, a round rod made of a polycarbonate with a diameter of 120 mm and a length of 1000 mm was prepared. Next, the round rod was subjected to smoothing treatment. Next, the round rod was roughly cut using a lathe processing machine to produce a winding core outer-shape body having a rough outer shape of a winding core section 2. Next, the winding core outer-shape body was subjected to smoothing treatment. At this stage, the sticking surface 22 becomes smooth. Next, small parts of the winding core outer-shape body were subjected to finishing processing using a lathe processing machine, and thereby a winding core section 2 was produced.

On the other hand, a plate-like member made of a polycarbonate with a thickness of 3 mm was prepared. Next, the plate-like member was processed using a lathe processing machine, and thereby a flange section 3 was produced. The diameter F of the flange section 3 was set to 170 mm. Next, the flange section 3 was stuck to the sticking surface 22 of the winding core section 2; thus, a reel member 1 was produced. Here, screws were used for the sticking. The sticking positions were set to the positions shown in FIG. 1, that is, positions distant from each other by 60° along the round direction of the sticking surface 22. That is, the flange section 3 was fixed to the winding core section 2 at six sticking positions per sheet.

Each dimension of the reel member 1 is as follows: the diameter D of the winding core section 2=120 mm, the diameter F of the flange section 3=170 mm, D/F=0.706, the thickness t of the flange section 3=3 mm, the width B of the sticking surface 22=8 mm, the diameter A of the concavity 23=104 mm, B/A=0.077, the depth H of the concavity 23=20 mm, the distance C between the bottom surfaces 24=10 mm, H/C=2.0, and the distance L between the flange sections 3=50 mm.

(1-3. Measurement of Amount of Surface Runout)

Next, the amount of surface runout of the flange section 3 was measured in the following manner. First, four contact points 3*b* between one flange section 3 and the winding core section 2 were set at intervals of 90° along the round direction of the winding core section 2. Then, the amount of surface runout was measured using these contact points 3*b*. Specifically, the other flange section 3 was placed on a base prepared in advance, and the amount of surface runout was measured using a gauge indicator, TI-113HR (513-474), manufactured by Mitutoyo Corporation. The amount of surface runout of the other flange section 3 was similarly measured. Then, each of the maximum amounts of positive and negative runouts among the eight measurement values in total was taken as the amount of surface runout of the flange section 3.

(1-4. Production of Film Housing Body (Adhesive Film Winding Test))

The adhesive film was wound around the reel member 1, and thereby a film housing body 50 was produced. Here, the width w of the film winding section 50*a* was set to 49.5 mm. The winding of the adhesive film was performed in accordance with the method disclosed in Patent Literature 1. The traverse pitch was set to 1 mm, and the line speed was set to 25 M/min. Then, places of falling-off were measured by visual observation, and the film housing body 50 was evaluated in the following manner on the basis of the place of falling-off.

A: falling-off did not occur

B: falling-off occurred but was little (there was no practical problem)

C: the number of places where falling-off occurred was 1 to 5 in an area of 5000 m of the adhesive film D: the number of places where falling-off occurred was more than or equal to 6 in an area of 5000 m of the adhesive film (1-5. Adhesive Film Pulling-Out Test)

A pulling-out test machine of the inventor's own making that was fabricated using, as a reference, a commercially available film temporary adhesion and adhesion apparatus such as a film adhesion apparatus (model number: TTO-1794M) manufactured by Shibaura Mechatronics Corporation was prepared. Then, using the pulling-out test machine, a pulling-out test in which the adhesive film was pulled out from the film housing body 50 at a reel housing section temperature of 30 degrees, a pulling speed of 500 mm/sec, a pulling-out tension of 50 g, and a stroke of 250 mm was performed. The pulling-out test was performed until the entire adhesive film was pulled out from the film housing body 50. The number of times of falling-off was measured by visual observation, and the film housing body 50 was evaluated in the following manner on the basis of the number of times of falling-off.

A: falling-off did not occur

B: falling-off occurred but was little (there was no practical problem)

C: the number of times of occurrence of falling-off was 1 to 5 in an area of 5000 m of the adhesive film D: the number of times of occurrence of falling-off was more than or equal to 6 in an area of 5000 m of the adhesive film The diameter D of the winding core section 2, the diameter F of the flange section 3, D/F, the amount of surface runout, and the evaluation of falling-off are collectively shown in Table 1.

1-2. Examples 1-2 to 1-9 and Comparative Example 1-1

Similar processing to Example 1-1 was performed except that the diameter D of the winding core section 2 and the diameter F of the flange section 3 were changed as shown in Table 1. The dimensions (the diameter D of the winding core section 2, the diameter F of the flange section 3, and D/F), the amount of surface runout, and the evaluation of falling-off of the examples are collectively shown in Table 1.

TABLE 1

| | D (mm) | F (mm) | D/F | Amount of surface runout (mm) | Falling-off during winding | Falling-off during pulling-out |
|---|---|---|---|---|---|---|
| Example 1-1 | 120 | 170 | 0.706 | Within range of ±0.1 | A | A |
| Example 1-2 | 100 | 170 | 0.588 | Within range of ±0.15 | A | A |
| Example 1-3 | 80 | 170 | 0.471 | Within range of ±0.2 | A | B |
| Example 1-4 | 95 | 155 | 0.613 | Within range of ±0.1 | A | A |
| Example 1-5 | 75 | 155 | 0.484 | Within range of ±0.15 | B | A |
| Example 1-6 | 60 | 155 | 0.387 | Within range of ±0.2 | B | B |
| Example 1-7 | 70 | 135 | 0.519 | Within range of ±0.1 | A | A |
| Example 1-8 | 55 | 135 | 0.407 | Within range of ±0.15 | A | B |
| Example 1-9 | 40 | 135 | 0.296 | Within range of ±0.2 | B | B |
| Comparative Example 1-1 | 80 | 250 | 0.320 | Less than or equal to −0.3 | C | D |

1-3. Consideration of Evaluation Results

As shown in Table 1, it has been found that, the smaller the amount of surface runout is, the less likely falling-off is to occur. That is, according to the present Examples, the amount of surface runout can be a value within the range of ±0.2 mm. Further, the amount of surface runout is preferably a value within the range of ±0.15 mm, and more preferably a value within the range of ±0.1 mm.

Figure 5:
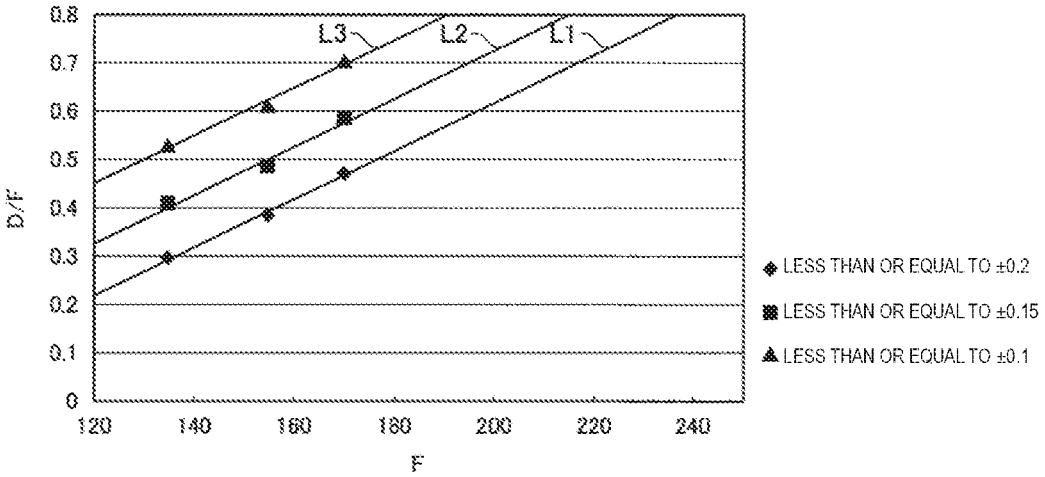
FIG. 5 is a graph showing corresponding relationships between a ratio (D/F) of a diameter (D) of a winding core section to a diameter (F) of a flange section, and an outer diameter (F) of the flange section.

Further, as shown in FIG. 5, the results of Examples 1-1 to 1-9 were plotted on an xy plane with the diameter F of the flange section 3 on the horizontal axis and D/F on the vertical axis. The kind of each point was changed in accordance with the amount of surface runout. As a result, it has been found that a straight line that links the same kind of points can be drawn. That is, straight line L1 is a straight line that links points of which the amount of surface runout is within the range of ±0.2, straight line L2 is a straight line that links points of which the amount of surface runout is within the range of ±0.15, and straight line L3 is a straight line that links points of which the amount of surface runout is within the range of ±0.1.

Straight line L1 is expressed by Mathematical Formula (1-1') below.

$$D/F=0.005*F-0.38 \quad (1\text{-}1')$$

Straight line L2 is expressed by Mathematical Formula (1-2') below.

$$D/F=0.005*F-0.27 \quad (1\text{-}2')$$

Straight line L3 is expressed by Mathematical Formula (1-3') below.

$$D/F=0.005*F-0.14 \quad (1\text{-}3')$$

From the above results, it can be said that, in the case where the diameter D of the winding core section 2 and the diameter F of the flange section 3 satisfy Mathematical Formula (1-1) described above, the amount of surface runout is a value within the range of ±0.2. Further, it can be said that, in the case where the diameter D of the winding core section 2 and the diameter F of the flange section 3 satisfy Mathematical Formula (1-2) described above, the amount of surface runout is a value within the range of ±0.15. Further, it can be said that, in the case where the diameter D of the winding core section 2 and the diameter F of the flange section 3 satisfy Mathematical Formula (1-3) described above, the amount of surface runout is a value within the range of ±0.1. For example, Comparative Example 1-1 does not satisfy Mathematical Formula (1-1), and therefore the amount of surface runout is less than or equal to −0.3.

1-4. Examples 1-10 to 1-12

Next, Examples 1-10 to 1-12 were performed in order to specify a preferred range of the ratio (B/A) of the width B of the sticking surface 22 to the diameter A of the concavity 23. In Examples 1-10 to 1-12, similar processing to Example 1-1 was performed except that the width B of the sticking surface 22 and the diameter A of the concavity 23 were changed to the values shown in Table 2, and thereby a reel member 1 was produced. Similar tests to Example 1-1 were performed, with the length of the adhesive film set to 5000 m. The categories of evaluation are as follows.

(1-4-1. Evaluation Categories of Winding Test)

A: falling-off did not occur

B: falling-off occurred but was little (there was no practical problem)

C: the number of places where falling-off occurred was 1 to 5 in an area of 5000 m of the adhesive film D: the number of places where falling-off occurred was more than or equal to 6 in an area of 5000 m of the adhesive film (1-4-2. Evaluation Categories of Pulling-Out Test)

A: falling-off did not occur

B: falling-off occurred but was little (there was no practical problem)

C: the number of times of occurrence of falling-off was 1 to 5 in an area of 5000 m of the adhesive film D: the number of times of occurrence of falling-off was more than or equal to 6 in an area of 5000 m of the adhesive film

TABLE 2

| | B (mm) | A (mm) | B/A | Amount of surface runout (mm) | Falling-off during winding | Falling-off during pulling-out |
|---|---|---|---|---|---|---|
| Example 1-10 | 8 | 104 | 0.077 | Within range of ±0.1 | A | A |
| Example 1-11 | 20 | 80 | 0.25 | Within range of ±0.15 | A | B |

TABLE 2-continued

| | B (mm) | A (mm) | B/A | Amount of surface runout (mm) | Falling-off during winding | Falling-off during pulling-out |
|---|---|---|---|---|---|---|
| Example 1-12 | 40 | 40 | 1.0 | Within range of ±0.2 | B | B |

From Table 2, it can be seen that the ratio (B/A) of the width B of the sticking surface 22 to the diameter A of the concavity 23 is preferably less than or equal to 1.0, more preferably less than or equal to 0.25, and still more preferably less than or equal to 0.08.

1-5. Examples 1-13 to 1-15

Next, Examples 1-13 to 1-15 were performed in order to specify a preferred range of the ratio (H/C) of the depth H of the concavity 23 to the distance C between the bottom surfaces 24 of the concavities 23. In Examples 1-13 to 1-15, similar processing to Example 1-1 was performed except that the diameter A of the concavity 23 was set to 104 mm, and the depth H of the concavity 23 and the distance C between the bottom surfaces 24 of the concavities 23 were changed to the values shown in Table 3; and thereby a reel member 1 was produced. A winding test and a pulling-out test were performed under similar conditions to Examples 1-10 to 1-12.

TABLE 3

| | H (mm) | C (mm) | H/C | Amount of surface runout (mm) | Falling-off during winding | Falling-off during pulling-out |
|---|---|---|---|---|---|---|
| Example 1-13 | 20 | 10 | 2.0 | Within range of ±0.1 | A | A |
| Example 1-14 | 10 | 30 | 0.33 | Within range of ±0.15 | A | B |
| Example 1-15 | 5 | 40 | 0.125 | Within range of ±0.2 | B | B |

From Table 3, it can be seen that the ratio (H/C) of the depth H of the concavity 23 to the distance C between the bottom surfaces 24 of the concavities 23 is preferably more than or equal to 0.12, more preferably more than or equal to 0.33, and still more preferably more than or equal to 2.0.

2-1. Example 2-1

Next, Examples of the second embodiment are described. In Example 2-1, the following experiment was conducted.

(1-1. Preparation of Adhesive Film)

An adhesive film including a matrix film made of PET with a width of 1 mm and a thickness of 38 μm, an adhesive layer with a thickness of 20 μm formed on the matrix film, and a release PET film with a thickness of 12 μm formed on the adhesive layer was prepared. The length of the adhesive film was set to 5000 m. Specifically, a plurality of adhesive films of approximately 100 m were produced, and these were linked; thereby, an adhesive film of 5000 m was produced.

Here, the adhesive layer was produced by the following process. Specifically, an adhesive composition containing 30 parts by mass of a phenoxy resin (YP-50, manufactured by Nippon Steel Chemical Co., Ltd.), 20 parts by mass of a liquid epoxy resin (JER828, manufactured by Mitsubishi Chemical Corporation), 10 parts by mass of a rubber component (SG80H, manufactured by Nagase ChemteX Corporation), 40 parts by mass of a hardening agent (Novacure 3941HP, manufactured by Asahi Kasei Corporation), and 1 part by mass of a silane coupling agent (A-187, manufactured by Momentive Performance Materials Inc.) was prepared.

Then, the adhesive composition was dissolved in solvent toluene to prepare an application liquid, and the application liquid was applied on the matrix film. Then, the application layer was heated at 50° C. for 10 minutes to volatilize the solvent. By the above process, the adhesive layer was produced. The lowest melt viscosity of the adhesive layer was 7.0×103 Pa·s. The lowest melt viscosity of the adhesive layer is a value measured using a rotary rheometer (manufactured by TA Instruments, Inc.). The measurement was performed using a measuring plate with a diameter of 8 mm while the rate of temperature increase was set constant at 10° C./minute and the force during measurement was set constant at 1 N.

(1-2. Production of Reel Member)

A reel member 201 was molded by the manufacturing method shown in FIG. 12B. Here, an S-2000i, 300 t type manufactured by Mitsubishi Heavy Industries Plastic Technology Co., Ltd. was used as the molding apparatus, and a general-purpose slide core-type mold was used as the mold. The injection molding was performed by the following process. That is, a polycarbonate resin melted by heating at approximately 300° C. was injected into the mold, and was held at a holding pressure of approximately 1200 kg/cm$^2$. Next, cooling was performed for 30 seconds to solidify the resin. By the above process, the injection molding was performed.

Figure 15:
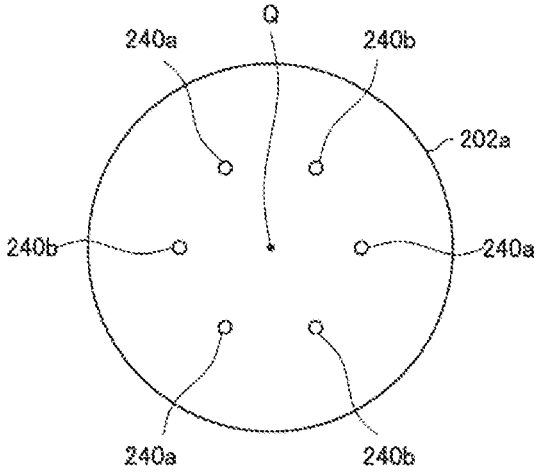
FIG. 15 is an explanatory diagram showing an uneven section formed on a surface of a divided winding core section.

Divided winding core sections 202*a* were stuck together by the impulse welding described above. The arrangement of protruding portions 240*a* and through holes 240*b* was as shown in FIG. 15, and an impulse welding machine manufactured by Munekata Industrial Machinery Co., Ltd. was used as the impulse welding machine. As conditions of the impulse welding, the energization time was set to 0.5 seconds, and the cooling time was set to 2 seconds. By the above process, a reel member 201 was produced. Each dimension of the reel member 201 is as follows: the diameter D of the winding core section 202=120 mm, the diameter F of the flange section 203=170 mm, D/F=0.706, the thickness t of the flange section 203=3 mm, the width B of the sticking surface 222=2 mm, the diameter A of the concavity 223=116 mm, B/A=0.017, the depth H of the concavity 223=23 mm, the distance C between the bottom surfaces 224=10 mm, H/C=2.3, and the distance L between the flange sections 203=50 mm.

(1-3. Measurement of Amount of Surface Runout)

Next, the amount of surface runout of the flange section 203 was measured in the following manner. First, four contact points 203*b* between one flange section 203 and the winding core section 202 were set at intervals of 90° along the round direction of the winding core section 202. Then, the amount of surface runout was measured using these contact points 203*b*. Specifically, the other flange section 203 of the reel member 201 was placed on a base prepared in advance, and the amount of surface runout was measured using a gauge indicator, TI-113HR (513-474), manufactured by Mitutoyo Corporation. The amount of surface runout of the other flange section 203 was similarly measured. Then, each of the maximum amounts of positive and negative runouts among the eight measurement values in total was taken as the amount of surface runout of the flange section 203.

(1-4. Production of Film Housing Body (Adhesive Film Winding Test))

The adhesive film was wound around the reel member 201, and thereby a film housing body 250 was produced. Here, the width w of the film winding section 250*a* was set to 49.5 mm. The winding of the adhesive film was performed in accordance with the method disclosed in Patent Literature 1. The traverse pitch was set to 1 mm, and the line speed was set to 25 M/min. Then, places of falling-off were measured by visual observation, and the film housing body 250 was evaluated in the following manner on the basis of the place of falling-off.

A: falling-off did not occur

B: falling-off occurred but was little (there was no practical problem)

C: the number of places where falling-off occurred was 1 to 5 in an area of 5000 m of the adhesive film D: the number of places where falling-off occurred was more than or equal to 6 in an area of 5000 m of the adhesive film (1-5. Adhesive Film Pulling-Out Test)

A pulling-out test machine of the inventor's own making that was fabricated using, as a reference, a commercially available film temporary adhesion and adhesion apparatus such as a film adhesion apparatus (model number: TTO-1794M) manufactured by Shibaura Mechatronics Corporation was prepared. Then, using the pulling-out test machine, the entire adhesive film was pulled out from the film housing body 250 at a reel housing section temperature of 30 degrees, a pulling speed of 500 mm/sec, a pulling-out tension of 50 g, and a stroke of 250 mm; the number of times of falling-off was measured by visual observation; and the film housing body 250 was evaluated in the following manner on the basis of the number of times of falling-off.

A: falling-off did not occur

B: falling-off occurred but was little (there was no practical problem)

C: the number of times of occurrence of falling-off was 1 to 5 in an area of 5000 m of the adhesive film D: the number of times of occurrence of falling-off was more than or equal to 6 in an area of 5000 m of the adhesive film The diameter D of the winding core section 202, the diameter F of the flange section 203, D/F, the amount of surface runout, and the evaluation of falling-off are collectively shown in Table 4.

2-2. Examples 2-2 to 2-9 and Comparative Example 2-1

Similar processing to Example 2-1 was performed except that the diameter D of the winding core section 202 and the diameter F of the flange section 203 were changed as shown in Table 4. The dimensions (the diameter D of the winding core section 202, the diameter F of the flange section 203, and D/F), the amount of surface runout, and the evaluation of falling-off of the examples are collectively shown in Table 4.

TABLE 4

| | D (mm) | F (mm) | D/F | Amount of surface runout (mm) | Falling-off during winding | Falling-off during pulling-out |
|---|---|---|---|---|---|---|
| Example 2-1 | 120 | 170 | 0.706 | Within range of ±0.1 | A | A |
| Example 2-2 | 100 | 170 | 0.588 | Within range of ±0.15 | A | A |
| Example 2-3 | 80 | 170 | 0.471 | Within range of ±0.2 | A | B |
| Example 2-4 | 95 | 155 | 0.613 | Within range of ±0.1 | A | A |
| Example 2-5 | 75 | 155 | 0.484 | Within range of ±0.15 | B | A |
| Example 2-6 | 60 | 155 | 0.387 | Within range of ±0.2 | B | B |
| Example 2-7 | 70 | 135 | 0.519 | Within range of ±0.1 | A | A |
| Example 2-8 | 55 | 135 | 0.407 | Within range of ±0.15 | A | B |
| Example 2-9 | 40 | 135 | 0.296 | Within range of ±0.2 | B | B |
| Comparative Example 2-1 | 80 | 250 | 0.320 | Less than or equal to −0.3 | C | D |

2-3. Consideration of Evaluation Results

As shown in Table 4, it has been found that, the smaller the amount of surface runout is, the less likely falling-off is to occur. That is, according to the present Examples, the amount of surface runout can be a value within the range of ±0.2 mm. Further, the amount of surface runout is preferably a value within the range of ±0.15 mm, and more preferably a value within the range of ±0.1 mm.

Figure 16:
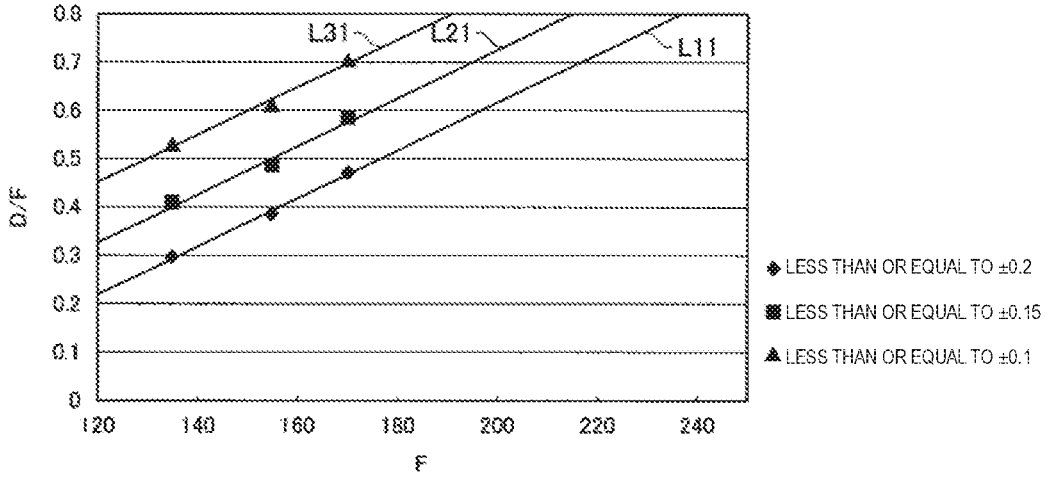
FIG. 16 is a graph showing corresponding relationships between a ratio (D/F) of a diameter (D) of a winding core section to a diameter (F) of a flange section, and an outer diameter (F) of the flange section.

Further, as shown in FIG. 16, the results of Examples 2-1 to 2-9 were plotted on an xy plane with the diameter F of the flange section 203 on the horizontal axis and D/F on the vertical axis. The kind of each point was changed in accordance with the amount of surface runout. As a result, it has been found that a straight line that links the same kind of points can be drawn. That is, straight line L11 is a straight line that links points of which the amount of surface runout is within the range of ±0.2, straight line L21 is a straight line that links points of which the amount of surface runout is within the range of ±0.15, and straight line L31 is a straight line that links points of which the amount of surface runout is within the range of ±0.1.

Straight line L11 is expressed by Mathematical Formula (2-1') below.

$$D/F=0.005*F-0.38 \quad (2\text{-}1')$$

Straight line L21 is expressed by Mathematical Formula (2-2') below.

$$D/F=0.005*F-0.27 \quad (2\text{-}2')$$

Straight line L31 is expressed by Mathematical Formula (2-3') below.

$$D/F=0.005*F-0.14 \quad (2\text{-}3')$$

From the above results, it can be said that, in the case where the diameter D of the winding core section 202 and the diameter F of the flange section 203 satisfy Mathematical Formula (2-1) described above, the amount of surface runout is a value within the range of ±0.2. Further, it can be said that, in the case where the diameter D of the winding core section 202 and the diameter F of the flange section 203 satisfy Mathematical Formula (2-2) described above, the amount of surface runout is a value within the range of ±0.15. Further, it can be said that, in the case where the diameter D of the winding core section 202 and the diameter F of the flange section 203 satisfy Mathematical Formula (2-3) described above, the amount of surface runout is a value within the range of ±0.1. For example, Comparative Example 1 does not satisfy Mathematical Formula (2-1), and therefore the amount of surface runout is less than or equal to −0.3.

The preferred embodiment(s) of the present invention has/have been described above with reference to the accompanying drawings, whilst the present invention is not limited to the above examples. A person skilled in the art may find various alterations and modifications within the scope of the appended claims, and it should be understood that they will naturally come under the technical scope of the present invention.

REFERENCE SIGNS LIST

1 reel member
2 winding core section
3 flange section
21 peripheral surface
22 sticking surface
23 concavity
24 bottom surface
24*a* material removal section
24*b* through hole for a shaft
25 sticking member
50 film housing body
50*a* film winding section
201 reel member
202 winding core section
203 flange section
221 peripheral surface
222 sticking surface
223 concavity
224 bottom surface
224*b* through hole for a shaft
224*c* rib
250 film housing body
250*a* film winding section

The invention claimed is:

1. A reel member comprising:
a winding core section around which an adhesive film is wound; and
a flange section provided on each of both end portions in a direction of a rotation axis of the winding core section,
wherein the winding core section and the flange section are provided separately from each other, and
an amount of surface runout of the flange section is a value within a range of ±0.2 mm,
wherein a diameter of the winding core section and a diameter of the flange section satisfy Mathematical Formula (1-1) below, $$D/F \geq 0.005*F-0.38 \quad (1\text{-}1),$$

where D is measured in mm and represents the diameter of the winding core section, and F is measured in mm represents the diameter of the flange section,
wherein the winding core section and the flange section satisfying Mathematical Formula (1-1) provides for the amount of surface runout of the flange section being the value within the range of ±0.2 mm,
wherein a diameter of the winding core section is more than or equal to 40 mm, and
wherein a diameter of the flange section is more than or equal to 135 mm.

2. The reel member according to claim 1,
wherein a sticking surface to which the flange section is stuck is formed in each of both end portions in the direction of the rotation axis of the winding core section.

3. The reel member according to claim 2,
wherein the flange section is fixed to the sticking surface by a sticking member.

4. The reel member according to claim 2, comprising:
a concavity formed in each of both end portions in the direction of the rotation axis of the winding core section,
wherein the sticking surface is placed around the concavity.

5. The reel member according to claim 4,
wherein material removal sections are formed in a bottom surface of the concavity.

6. The reel member according to claim 5,
wherein the material removal sections are placed in positions symmetrical with respect to the rotation axis of the winding core section.

7. A reel member comprising:
a winding core section around which an adhesive film is wound; and
a flange section provided on each of both end portions in a direction of a rotation axis of the winding core section,
wherein at least one or more of the winding core section and the two flange sections are a molded product, and
an amount of surface runout of each of the flange sections is a value within a range of ±0.2 mm,
wherein a diameter of the winding core section and a diameter of the flange section satisfy Mathematical Formula (2-1) below, $$D/F \geq 0.005*F-0.38 \quad (2\text{-}1)$$

where D is measured in mm and represents the diameter of the winding core section, and F is measured in mm represents the diameter of the flange section,
wherein the winding core section and the flange section satisfying Mathematical Formula (2-1) provides for the amount of surface runout of the flange section being the value within the range of ±0.2 mm,
wherein a diameter of the winding core section is more than or equal to 40 mm, and
wherein a diameter of the flange section is more than or equal to 135 mm.

8. The reel member according to claim 7,
wherein at least one flange section of the two flange sections is molded integrally with the winding core section.

9. The reel member according to claim 7, comprising:
a concavity formed in each of both end portions in the direction of the rotation axis of the winding core section.

10. The reel member according to claim 9,
wherein ribs extending radially from the rotation axis of the winding core section are formed on a bottom surface of the concavity.

11. The reel member according to claim 10,
wherein the ribs are placed in positions symmetrical with respect to the rotation axis of the winding core section.

12. The reel member according to claim 1,
wherein a distance between the flange sections is more than or equal to 10 mm.

13. The reel member according to claim 7,
wherein a distance between the flange sections is more than or equal to 10 mm.

14. The reel member according to claim 2,
wherein a ratio B/A of width B of the sticking surface to a diameter A of a concavity is less than or equal to 0.08.

15. The reel member according to claim 3,
wherein the sticking member is a removable screw.

16. The reel member according to claim 3,
wherein the sticking member is a permanent screw.

17. The reel member according to claim 7,
wherein the winding core section includes a plurality of divided winding core sections linked in the direction of the rotation axis of the winding core section.

18. A method for manufacturing the reel member according to claim 1 comprising:
a step of producing one or a plurality of molded products that form a part or a whole of a reel member including
a winding core section around which an adhesive film is windable, and
a flange section provided on each of both end portions of the winding core section; and
a step of sticking the molded products together to produce the reel member in a case where the molded product forms a part of the reel member.

* * * * *